US006908356B2

(12) United States Patent
Ohnishi et al.

(10) Patent No.: US 6,908,356 B2
(45) Date of Patent: Jun. 21, 2005

(54) ELECTRON-EMITTING DEVICE, ELECTRON SOURCE, AND IMAGE-FORMING APPARATUS

(75) Inventors: Toshikazu Ohnishi, Tokyo (JP); Masato Yamanobe, Tokyo (JP); Ichiro Nomura, Kanagawa-ken (JP); Hidetoshi Suzuki, Kanagawa-ken (JP); Yoshikazu Banno, Kanagawa-ken (JP); Takeo Ono, Tokyo (JP); Masanori Mitome, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/615,995

(22) Filed: Jul. 10, 2003

(65) Prior Publication Data

US 2004/0082249 A1 Apr. 29, 2004

Related U.S. Application Data

(62) Division of application No. 09/332,101, filed on Jun. 14, 1999, now Pat. No. 6,802,752, which is a division of application No. 08/264,497, filed on Jun. 23, 1994, now Pat. No. 6,169,356.

(30) Foreign Application Priority Data

Dec. 27, 1993 (JP) ..... 5-331103
Dec. 28, 1993 (JP) ..... 5-335925
Jun. 20, 1994 (JP) ..... 6-137317

(51) Int. Cl.[7] ..... H01J 9/00
(52) U.S. Cl. ..... 445/50; 445/6
(58) Field of Search ..... 445/50, 51, 24, 445/25, 6; 313/309, 336, 310, 355, 422, 258, 346 R, 512; 345/75, 77; 315/169.1, 169.3

(56) References Cited

U.S. PATENT DOCUMENTS

| | | | | |
|---|---|---|---|---|
| 4,949,019 | A | 8/1990 | Isaka et al. | 445/6 |
| 4,954,744 | A | 9/1990 | Suzuki et al. | 313/336 X |
| 5,006,883 | A | 4/1991 | Ohashi et al. | 313/309 |

(Continued)

FOREIGN PATENT DOCUMENTS

| | | | |
|---|---|---|---|
| CN | 1069826 A | 3/1993 | H01J/1/30 |
| CN | 1069828 A | 3/1993 | H01J/19/42 |
| EP | 0 299 461 | 1/1989 | |

(Continued)

OTHER PUBLICATIONS

"Metal Influence on Switching MIM Diodes", H. Pagnia, et al., Phys. Stat. Sol. (a), 111, 387 (1989).

"Scanning Tunnelling Microscopic Investigations of Electroformed Planar Metal–Insulator–Metal Diodes," H. Pagnia, N. Sotnik and W. Wirth, Int. J. Electronics, vol. 69, No. 1, 25–32 (1990).

(Continued)

*Primary Examiner*—Joseph Williams
(74) *Attorney, Agent, or Firm*—Fitzpatrick, Cella, Harper & Scinto

(57) ABSTRACT

An electron-emitting device comprises a pair of oppositely disposed electrodes and an electroconductive film arranged between the electrodes and including a high resistance region. The high resistance region has a deposit containing carbon as a principal ingredient. The electron-emitting device can be used for an electron source of an image-forming apparatus of the flat panel type.

6 Claims, 20 Drawing Sheets

U.S. PATENT DOCUMENTS

| | | | | |
|---|---|---|---|---|
| 5,066,883 | A | 11/1991 | Yoshioka et al. | 313/309 |
| 5,141,460 | A | 8/1992 | Jaskie et al. | 313/309 X |
| 5,256,936 | A | 10/1993 | Itoh et al. | 313/309 X |
| 5,285,129 | A | 2/1994 | Takeda et al. | 313/309 X |
| 5,591,061 | A | 1/1997 | Ikeda et al. | 445/3 |
| 6,147,449 | A | 11/2000 | Iwasaki et al. | 313/495 |
| 6,169,356 | B1 | 1/2001 | Ohnishi et al. | 313/495 |
| 6,171,162 | B1 | 1/2001 | Iwasaki et al. | 445/6 |
| 6,184,610 | B1 | 2/2001 | Shibata et al. | 313/309 |
| 6,246,168 | B1 | 6/2001 | Kishi et al. | 313/495 |
| 6,348,761 | B1 | 2/2002 | Nomura et al. | 313/495 |
| 6,384,541 | B1 | 5/2002 | Ohnishi et al. | 315/169.3 |

FOREIGN PATENT DOCUMENTS

| | | | | |
|---|---|---|---|---|
| EP | 0 513 777 | A2 | 11/1992 | H01J/1/30 |
| EP | 0523702 | A1 | 1/1993 | |
| EP | 536731 | A1 | 4/1993 | |
| EP | 0 536 732 | A1 | 4/1993 | |
| JP | 1-031332 | | 2/1989 | H01J/29/48 |
| JP | 1283749 | A | 11/1989 | |
| JP | 01292728 | A | 11/1989 | H01J/1/30 |
| JP | A1309242 | | 12/1989 | |
| JP | 1-309242 | | 12/1989 | |

OTHER PUBLICATIONS

"Energy Distribution of Emitted Electrons from Electroformed MIM Structures: The Carbon Island Model," M. Bischoff, H. Pagnia and J. Trickl, Int. J. Electronics, vol. 73, No. 5, 1009–1010 (1992).

"Thin Film Handbook," Committee 131 of Japanese Society for the Promotion of Art and Science.

"On the Electron Emission from Evaporated Thin Au Films," M. Bischoff, R. Holzer and H. Pagnia, Physics Letters, vol. 62A, No. 7 (Oct. 3, 1977).

"The Electroforming Process in MIM Diodes," vol. 85, R. Blessing, H. Pagnia and N. Sotnik, Thin Solid Films, 119–128 (1981).

"Evidence for the Contribution of an Adsorbate to the Voltage–Controlled Negative Resistance of Gold Island Film Diodes," R. Blessing, H. Pagnia and R. Schmitt, Thin Solid Films, vol. 78, 397–401 (1981).

"Water–Influenced Switching in Discontinuous Au Film Diodes," R. Muller and H. Pagnia, Materials Letters, vol. 2, No. 4A, 283–285 (Mar. 1984).

"Influence of Organic Molecules on the Current–Voltage Characterisitc of Planar MIM Diodes," H. Pagnia, N. Sotnik and H. Strauss, Phy. Stat. Sol., vol. 90, 771–778 (1985).

"Influence of Gas Composition on Regeneration in Metal/Insulator/Metal Diodes," M. Borbonus, H. Pagnia and N. Sotnik, Thin Solid Films, vol. 151, 333–342 (1987).

"Prospects for Metal/Non–Metal Microsystems: Sensors, Sources and Switches," H. Pagnia, Int. J. Electronics, vol. 73, No. 5, 319–825 (1992).

W.P. Dyke, et al., "Field Emission,"Advances in Electronics and Electron Physics, 1956, pp. 90–185.

C.A. Spindt, et al. "Physical Properties of Thin–Film Field Emission Cathodes with Molybdenum Cones," J. Appl. Phys., vol. 47 (1976) pp. 5248–5263.

C.A. Mead, "Operation of Tunnel–Emission Devices," J. Appl. Phys., vol. 32, (1961) pp. 646–652.

M.I. Elinson "The Emission of Hot Electrons and the Field Emission of Electrons from Tin Oxide," Radio Engineering and Electronic Physics, (1965), pp. 1290–1296.

G. Dittner, "Electrical Conduction and Electron Emission of Discontinuous Thin Films," Thin Solid Films, 9, (1972) pp. 317–328.

H. Hartwell, et al, "Strong Electron Emission From Patterned Tin–Indium Oxide Thin Films," Int'l Electron Devices Meeting (1976) pp. 519–521.

M. Araki, "Electroforming and Electron Emission of Carbon Thin Films," J. Vac. Soc. Japan, 26, (1983) pp. 22–29.

"Carbon–Nanoslit Model for the Electroforming Process in MIM Structures," m. Bischoff, Int. J. Electronics, vol. 70, No. 3, 491–498 (1991).

Patent Abstracts of Japan, vol. 14, No. 1 08 (E–896) (4051), Feb. 27, 1990.

STRIPE

MATRIX

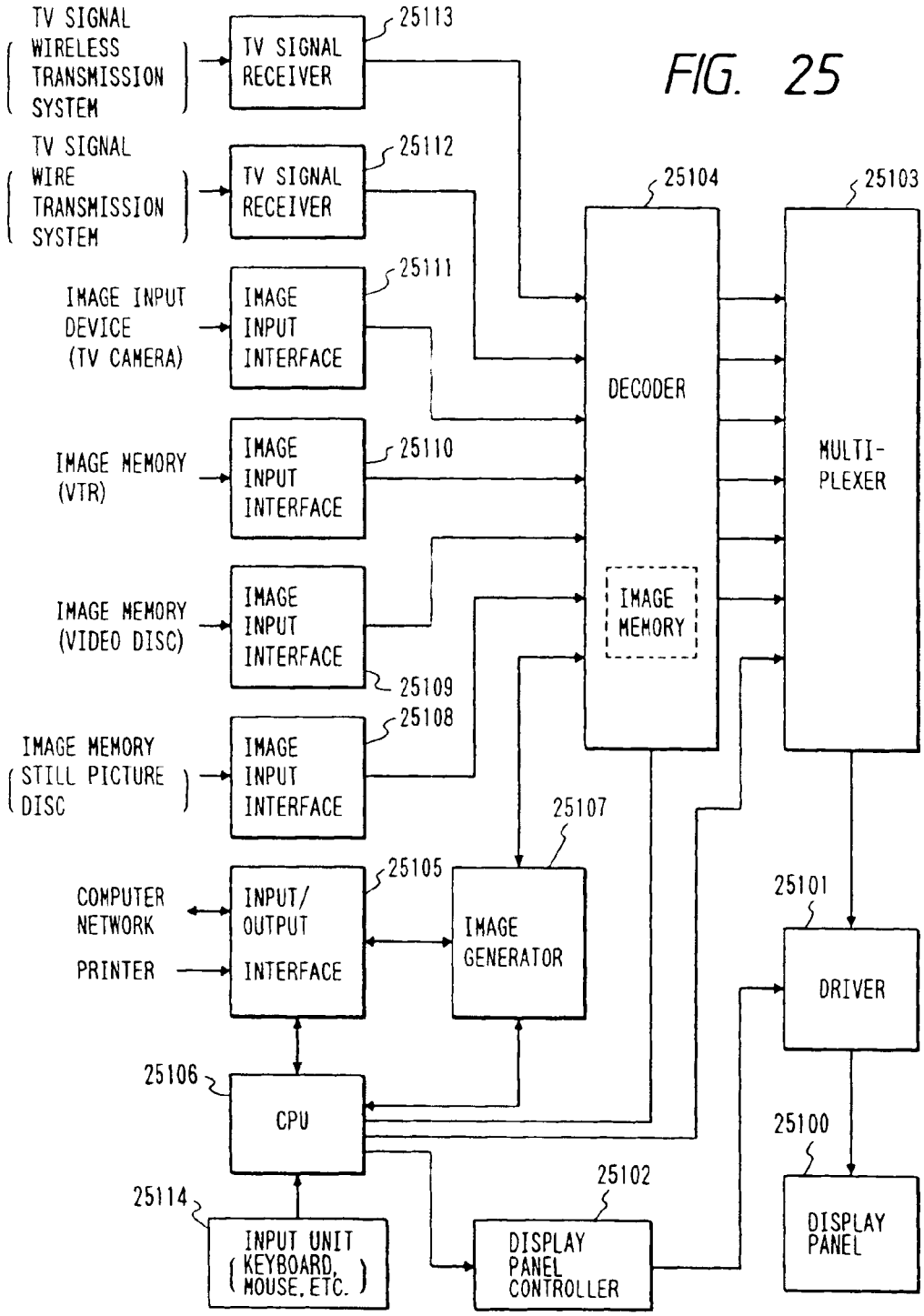
FIG. 25
TV SIGNAL WIRELESS TRANSMISSION SYSTEM
TV SIGNAL RECEIVER
25113
TV SIGNAL WIRE TRANSMISSION SYSTEM
TV SIGNAL RECEIVER
25112
IMAGE INPUT DEVICE (TV CAMERA)
IMAGE INPUT INTERFACE
25111
IMAGE MEMORY (VTR)
IMAGE INPUT INTERFACE
25110
IMAGE MEMORY (VIDEO DISC)
IMAGE INPUT INTERFACE
25109
IMAGE MEMORY STILL PICTURE DISC
IMAGE INPUT INTERFACE
25108
COMPUTER NETWORK
PRINTER
INPUT/ OUTPUT INTERFACE
25105
IMAGE GENERATOR
25107
DECODER
IMAGE MEMORY
25104
MULTI-PLEXER
25103
DRIVER
25101
DISPLAY PANEL
25100
CPU
25106
INPUT UNIT (KEYBOARD, MOUSE, ETC.)
25114
DISPLAY PANEL CONTROLLER
25102

ELECTRON-EMITTING DEVICE, ELECTRON SOURCE, AND IMAGE-FORMING APPARATUS

RELATED APPLICATIONS

This application is a division of application Ser. No. 09/332,101, filed Jun. 14, 1999, now U.S. Pat. No. 6,802,752, which is a division of application Ser. No. 08/264,497, filed Jun. 23, 1994 now U.S. Pat. No. 6,169,356.

BACKGROUND OF THE INVENTION

1. Field of the Invention

This invention relates to an electron source and an image-forming apparatus such as a display apparatus incorporating an electron source and, more particularly, it relates to a novel surface conduction electron-emitting device as well as a novel electron source and an image-forming apparatus such as a display apparatus incorporating such an electron source.

2. Related Background Art

There have been known two types of electron-emitting devices; the thermoelectron type and the cold cathode type. Of these, the cold cathode type includes the field emission type (hereinafter referred to as the FE-type), the metal/insulation layer/metal type (hereinafter referred to as the MIM-type) and the surface conduction type.

Examples of the FE electron-emitting device are described in W. P. Dyke & W. W. Dolan, "Field Emission". Advances in Electron Physics, 8, 89 (1956) and C. A. Spindt, "PHYSICAL Properties of thin-film field emission cathodes with molybdenum cones", J. Appl. Phys., 47, 5284 (1976).

MIM devices are disclosed in papers including C. A. Mead, "The tunnel-emission amplifier", J. Appl. Phys., 32, 646 (1961). Surface-conduction electron-emitting devices are proposed in papers including M. I. Elinson, Radio Eng. Electron Phys., 10 (1965).

An SCE device is realized by utilizing the phenomenon that electrons are emitted out of a small thin film formed on a substrate when an electric current is forced to flow in parallel with the film surface. While Elinson proposes the use of $SnO_2$ thin film for a device of this type, the use of Au thin film is proposed in G. Dittmer: "Thin Solid Films", 9, 317 (1972) whereas the use of In $_2O_3/SnO_2$ and that of carbon thin film are discussed respectively in M. Hartwell and C. G. Fonstad: "IEEE Trans. ED Conf.", 519 (1975) and H. Araki et al.: "Vacuum", Vol. 26, No. 1, p. 22 (1983).

FIG. 27 of the accompanying drawings schematically illustrates a typical surface-conduction electron-emitting device proposed by M. Hartwell. In FIG. 27, reference numeral 1 denotes a substrate. Reference numeral 2 denotes an electrically conductive thin film normally prepared by producing an H-shaped thin metal oxide film by means of sputtering, part of which eventually makes an electron-emitting region 3 when it is subjected to an electrically energizing process referred to as "electric forming" as described hereinafter. In FIG. 27, the thin horizontal area of the metal oxide film separating a pair of device electrodes has a length L of 0.5 to 1 mm and a width W of 0.1 mm. Note that the electron-emitting region 3 is only schematically shown because there is no way to accurately know its location and contour.

As described above, the conductive film 2 of such a surface conduction electron-emitting device is normally subjected to an electrically energizing preliminary process, which is referred to as "electric forming", to produce an electron emitting region 3. In the electric forming process, a DC voltage or a slowly rising voltage that rises typically at a rate of 1 V/min. is applied to given opposite ends of the conductive film 2 to partly destroy, deform or transform the conductive film and produce an electron-emitting region 3 which is electrically highly resistive. Thus, the electron-emitting region 3 is part of the conductive film 2 that typically contains fissures therein so that electrons may be emitted from those fissures. The thin film 2 containing an electron-emitting region that has been prepared by electric forming is hereinafter referred to as a thin film 4 inclusive of an electron-emitting region. Note that, once subjected to an electric forming process, a surface conduction electron-emitting device comes to emit electrons from its electron-emitting region 3 whenever an appropriate voltage is applied to the thin film 4 inclusive of the electron-emitting region to make an electric current run through the device.

Known surface conduction electron-emitting devices having a configuration as described above are accompanied by various problems, which will be described hereinafter.

Since a surface conduction electron-emitting device as described above is structurally simple and can be manufactured in a simple manner, a large number of such devices can advantageously be arranged on a large area without difficulty. As a matter of fact, a number of studies have been made to fully exploit this advantage of surface conduction electron-emitting devices. Applications of devices of the type under consideration include charged electron beam sources and electronic displays. In typical examples of applications involving a large number of surface conduction electron-emitting devices, the devices are arranged in parallel rows to show a ladder-like shape and each of the devices are respectively connected at given opposite ends with wirings (common wirings) that are arranged in columns to form an electron source (as disclosed in Japanese Patent Application Laid-open Nos. 64-31332, 1-283749 and 1-257552). As for display apparatuses and other image-forming apparatuses comprising surface conduction electron-emitting devices such as electronic displays, although flat-panel type displays comprising a liquid crystal panel in place of a CRT have gained popularity in recent years, such displays are not without problems. One of the problems is that a light source needs to be additionally incorporated into the display in order to illuminate the liquid crystal panel because the display is not of the so-called emission type and, therefore, the development of emission type display apparatuses has been eagerly expected in the industry. An emission type electronic display that is free from this problem can be realized by using a light source prepared by arranging a large number of surface conduction electron-emitting devices in combination with fluorescent bodies that are made to shed visible light by electrons emitted from the electron source (see, for example, U.S. Pat. No. 5,066,883).

In a conventional light source comprising a large number of surface conduction electron-emitting devices arranged in the form of a matrix, devices are selected for electron emission and subsequent light emission of fluorescent bodies by applying drive signals to appropriate row-directed wirings connecting respective rows of surface conduction electron-emitting devices in parallel, column-directed wirings connecting respective columns of surface conduction electron-emitting devices in parallel and control electrodes (or grids arranged within a space separating the electron source and the fluorescent bodies along the direction of the columns of surface conduction electron-emitting devices of a direction perpendicular to that of the rows of devices (see, for example, Japanese Patent Application Laid-open No. 1-283749).

However, little is known about the behavior in vacuum of a surface conduction electron-emitting device to be used for an electron source and an image-forming apparatus incorporating such an electron source and, therefore, it has been desired to provide surface conduction electron-emitting devices that have stable electron-emitting characteristics and hence can be operated efficiently in a controlled manner. The efficiency of a surface conduction electron-emitting device is defined for the purpose of the present invention as the ratio of the electric current running between the pair of device electrodes of the device (hereinafter referred to device current If) to the electric current produced by the emission of electrons into vacuum (hereinafter referred to emission current Ie). It is desired to have a large emission current with a small device current.

The inventors of the present invention who have long been engaged in the study of this technological field strongly believe that contaminants excessively deposited on and near the electron-emitting region of a surface conduction electron-emitting device can deteriorate the performance of the device, that contaminants are mainly decomposition products of oil in the evacuation system used for the device and that such deterioration can be prevented if the electron-emitting region is controlled in terms of shape, material and composition.

Thus, a low electricity consuming high quality image-forming apparatus typically comprising an image-forming member of fluorescent bodies can be realized if there provided a surface conduction electron-emitting device that has stable electron-emitting characteristics and hence can be operated efficiently in a controlled manner. Such an improved image-forming apparatus may be a very flat television set. A low energy consuming image-forming apparatus may require less costly drive circuits and other related components.

SUMMARY OF THE INVENTION

In view of the above described circumstances, it is therefore an object of the present invention to provide a novel and highly efficient electron-emitting device that has stable electron-emitting characteristics with a low device current level and a high emission current and hence can be operated efficiently in a controlled manner and a novel method of manufacturing the same well as a novel electron source incorporating such an electron-emitting and an image-forming apparatus such as a display apparatus using such an electron source.

According to an aspect of the invention, the above object and other objects of the invention are achieved by providing an electron-emitting device comprising a pair of oppositely disposed electrodes and an electroconductive film arranged between the electrodes and including a high resistance region, characterized in that the high resistance region has a deposit containing carbon as a principal ingredient.

According to another aspect of the invention, there is provided a method of manufacturing an electron-emitting device comprising a pair of oppositely disposed electrodes and an electroconductive film arranged between the electrodes and including a high resistance region, characterized in that it comprises a step of activating the device.

According to still another aspect of the invention, there is provided an electron source comprising an electron-emitting device for emitting electrons as a function of input signals characterized in that said electron-emitting device is produced with the above described method.

According to a further aspect of the invention, there is provided an image-forming apparatus comprising an electron source and an image-forming member for forming images as a function of input signals characterized in that said electron source comprises an electron-emitting device that is produced with the above described method.

Now, the present invention will be described in greater detail by referring to the accompanying drawings that illustrate preferred embodiments of the invention.

BRIEF DESCRIPTION OF THE DRAWINGS

FIG. 25 is a block diagram of the display apparatus of Example 10.

DETAILED DESCRIPTION OF THE PREFERRED EMBODIMENTS

Now, the present invention will be described in terms of preferred embodiments of the invention.

The present invention relates to a novel surface conduction electron-emitting device, a method of manufacturing the same and a novel electron source incorporation such a device as well as an image-forming apparatus such as a display apparatus incorporating such an electron source and applications of such an apparatus.

A surface conduction electron-emitting device according to the invention may be realized either as a flat type or as a step type. Firstly, a flat type surface conduction electron-emitting device will be described.

Figure 1A:
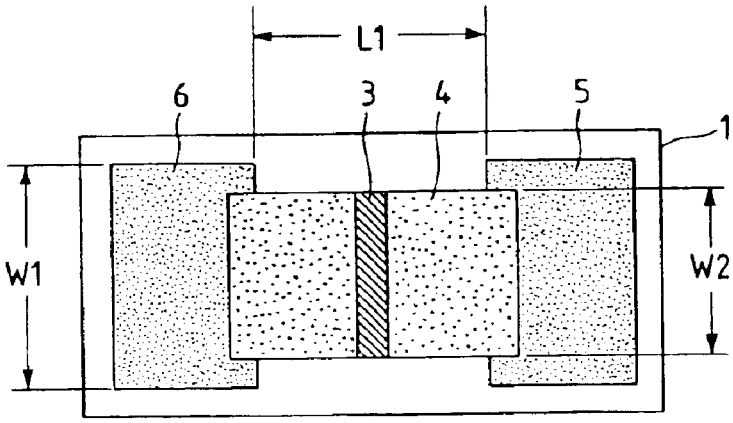
FIGS. 1A and 1B are schematic plan and sectional side views showing the basic configuration of a flat type surface conduction electron-emitting device according to the invention.
Figure 1B:
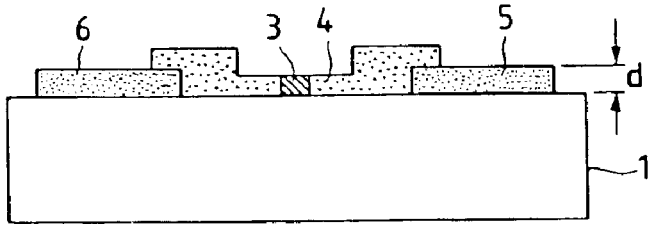

FIGS. 1A and 1B are schematic plan and sectional side views showing the basic configuration of a flat type surface conduction electron-emitting device according to the invention.

Referring to FIGS. 1A and 1B, the device comprises a substrate 1, a pair of device electrodes 5 and 6, a thin film 4 including an electron-emitting region 3.

Materials that can be used for the substrate 1 include quartz glass, glass containing impurities such as Na to a reduced concentration level, soda lime glass, glass substrate realized by forming an $SiO_2$ layer on soda lime glass by means of sputtering, and ceramic substances such as alumina.

While the oppositely arranged device electrodes 5 and 6 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd—Ag and glass, transparent conducting materials such as $In_2O_3$—$SnO_2$ and semiconductor materials such as poly-silicon.

The distance L1 separating the device electrodes, the length WI of the device electrodes, the contour of the electroconductive film 4 and other factors for designing a surface conduction electron-emitting device according to the invention may be determined depending on the application of the device. If, for instance, it is used for an image-forming apparatus such as a television set, it may have to have dimensions corresponding to those of each pixel that may be very small if the television set is of a high definition type, although it is required to provide a satisfactory emission current in order to ensure sufficient brightness for the screen of the television set while meeting the rigorous dimensional requirements.

The distance L1 separating the device electrodes 5 and 6 is preferably between hundreds of nanometers and hundreds of micrometers and, still more preferably, between several micrometers and several tens of micrometers depending on the voltage to be applied to the device electrodes and the field strength available for electron emission.

The length W1 of the device electrodes 5 and 6 is preferably between several micrometers and several hundreds of micrometers depending on the resistance of the electrodes and the electron-emitting characteristics of the device. The film thickness d of the device electrodes 5 and 6 is between several tens of nanometers and several micrometers.

A surface conduction electron-emitting device according to the invention may have a configuration other than the one illustrated in FIGS. 1A and 1B and, alternatively, it may be prepared by laying a thin film 4 including an electron-emitting region on a substrate 1 and then a pair of oppositely disposed device electrodes 5 and 6 on the thin film.

The electroconductive thin film 4 is preferably a fine particle film in order to provide excellent electron-emitting characteristics. The thickness of the electroconductive thin film 4 is determined as a function of the stepped coverage of the thin film on the device electrodes 5 and 6, the electric resistance between the device electrodes 5 and 6 and the parameters for the forming operation that will be described later as well as other factors and preferably between a nanometer and several hundreds of nanometers and more preferably between one manometer and fifty manometers. The thin film 4 normally shows a resistance per unit surface area between $10^3$ and $10^7$ Ω/□.

The thin film 4 including the electron-emitting region is made of fine particles of a material selected from metals such as Pd, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC and WC, nitrides such as TiN, ZrN and HfN, semiconductors such as Si and Ge and carbon.

The term "a fine particle film" as used herein refers to a thin film constituted of a large number of fine particles that may be loosely dispersed, tightly arranged or mutually and randomly overlapping (to form an island structure under certain conditions).

The diameter of fine particles to be used for the purpose of the present invention is between a nanometer and hundreds of several nanometers and preferably between a nanometer and twenty nanometers.

The electron-emitting region is part of the electroconductive thin film 4 and comprises electrically highly resistive fissures, although it is dependent on the thickness and the material of the electroconductive thin film 4 and the electric forming process which will be described hereinafter. It may contain electrocondcutive fine particles having a diameter between several angstroms and hundreds of several angstroms. The material of the electron-emitting region 3 may be selected from all or part of the materials that can be used to prepare the thin film 4 including the electron-emitting region. The thin film 4 contains carbon and/or carbon compounds in the electron-emitting region 3 and its neighboring areas.

A surface conduction type electron-emitting device according to the invention and having an alternative profile, or a step type surface conduction electron-emitting device, will be described.

Figure 26:
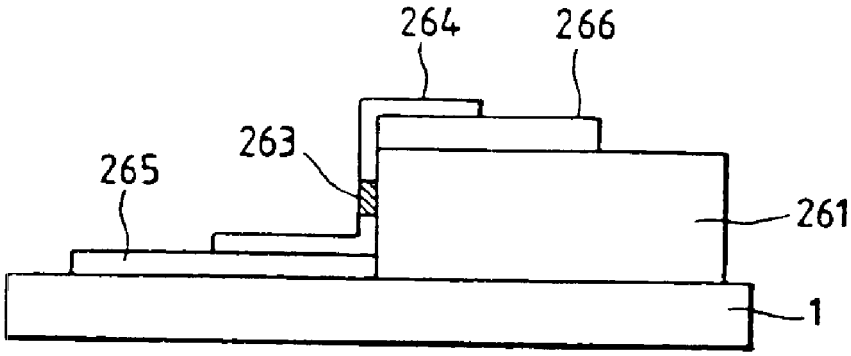
FIG. 26 is a schematic side view of an embodiment of step type surface conduction electron-emitting device according to the invention.
Figure 27:
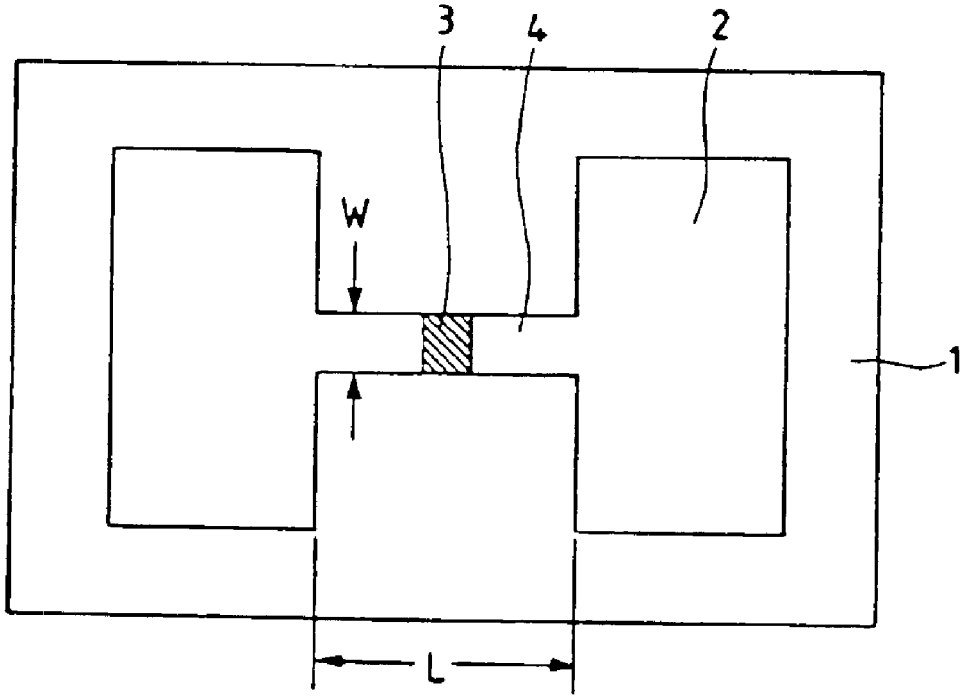
FIG. 27 PRIOR ART
FIG. 27 is a schematic plan view of a conventional surface conduction electron-emitting device.

FIG. 26 is a schematic perspective view of a step type surface conduction electron-emitting device, showing its basic configuration.

As seen in FIG. 26, the device comprises a substrate 1, a pair of device electrodes 265 and 266 and a thin film 264 including an electron-emitting region 263, which are made of the same materials as a flat type surface conduction electron-emitting device as described above, as well as a step-forming section 261 made of an insulating material such as $SiO_2$ produced by vacuum deposition, printing or sputtering and having a film thickness corresponding to the distance L1 separating the device electrodes of a flat type surface conduction electron-emitting device as described above, or between several tens of nanometers and several tens of micrometers and preferably between tens of nanometers and several micrometers, although it is selected as a function of the method of producing the step-forming section used there, the voltage to be applied to the device electrodes and the field strength available for electron emission.

As the thin film 264 including the electron-emitting region is formed after the device electrodes 265 and 266 and the step-forming section 261, it may preferably be laid on the device electrodes 265 and 266. While the electron-emitting region 263 is shown to have straight outlines in FIG. 26, its location and contour are dependent on the conditions under which it is prepared, electric forming conditions and other related conditions and not limited to straight outlines.

Figure 2A:
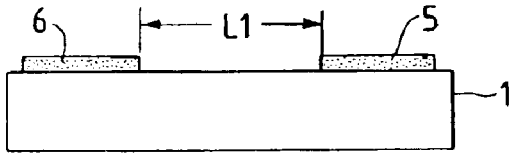
FIGS. 2A through 2C are schematic side views showing different steps of a method of manufacturing a surface conduction electron-emitting device according to the invention.
Figure 2B:
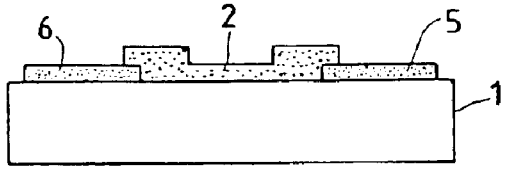
Figure 2C:
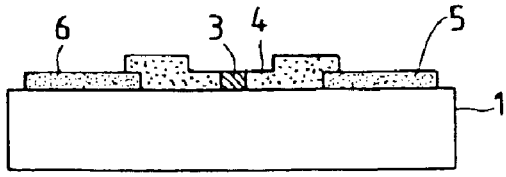

While various methods may be conceivable for manufacturing an electron-emitting device including an electron-emitting region 3, FIGS. 2A through 2C illustrate a typical one of such methods.

Now, a method of manufacturing a flat type surface conduction electron-emitting device according to the invention will be described by referring to FIGS. 1A and 1B and 2A through 2C.

1) After thoroughly cleansing a substrate 1 with detergent and pure water, a material is deposited on the substrate 1 by means of vacuum deposition, sputtering or some other appropriate technique for a pair of device electrodes 5 and 6, which are then produced by photolithography (FIG. 2A).

2) An organic metal thin film is formed on the substrate 1 between the pair of device electrodes 5 and 6 by applying an organic metal solution and leaving the applied solution for a given period of time. An organic metal solution as used herein refers to a solution of an organic compound containing as a principal ingredient a metal selected from the group of metals cited above including Pd, Ru, Ag, Au, Ti, In, Cu, Cr, Fe, Zn, Sn, Ta, W and Pb. Thereafter, the organic metal thin film is heated, sintered and subsequently subjected to a patterning operation, using an appropriate technique such as lift-off or etching, to produce a thin film 2 for forming an electron-emitting region (FIG. 2B). While an organic metal solution is used to produce a thin film in the above description, a thin film may alternatively be formed by vacuum deposition, sputtering, chemical vapor phase deposition, dispersed application, dipping, spinner or some other technique.

3) Thereafter, the device electrodes 5 and 6 are subjected to an electrically energizing process referred to as "forming", where a pulse voltage or a rising voltage is applied to the device electrodes 5 and 6 from a power source (not shown) to produce an electron-emitting region 3 in the thin film 2 forming an electron-emitting region (FIG. 2C). The area of the thin film 2 for forming an electron-emitting region that has been locally destroyed, deformed or transformed to undergo a structural change is referred to as an electron-emitting region 3.

All the remaining steps of the electric processing including the forming operation and the activation operation to be conducted on the device are carried out by using a gauging system which will be described below by referring to FIG. 3.

Figure 3:
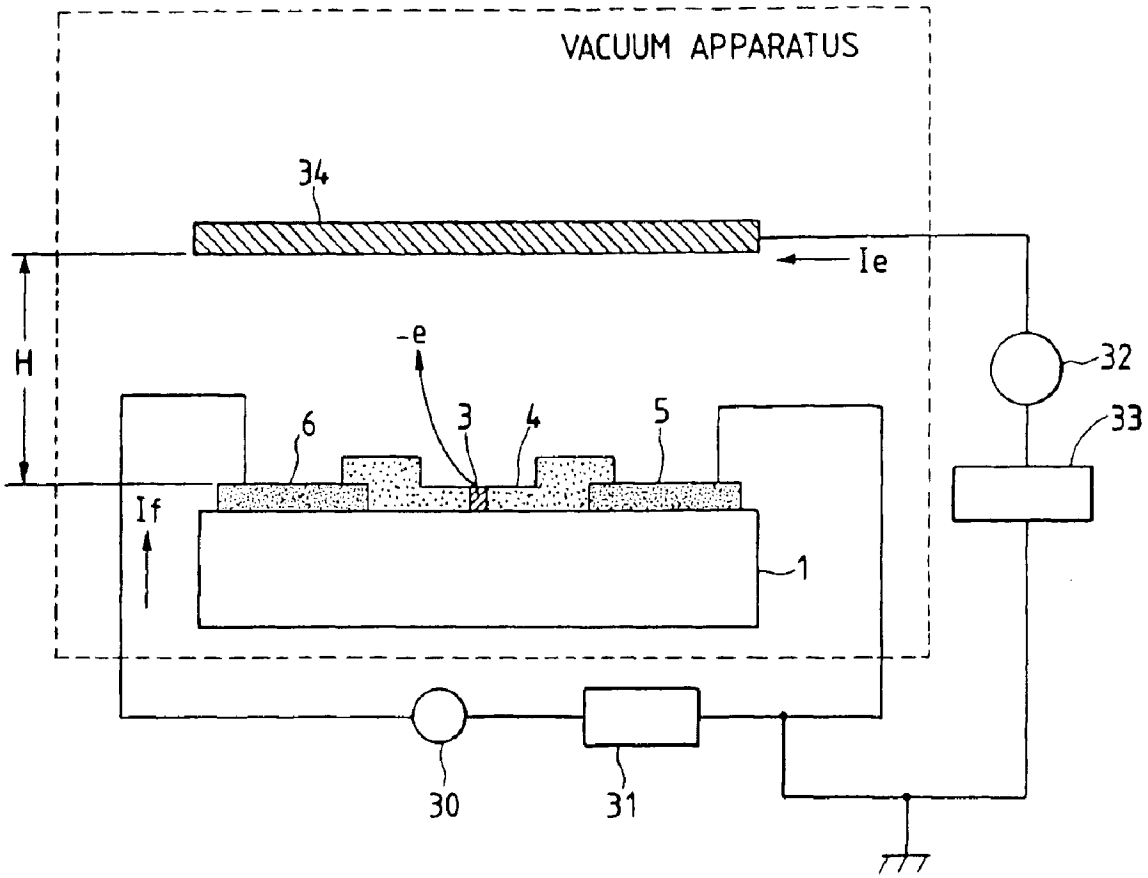
FIG. 3 is a block diagram of a gauging system for determining the performance of a surface-conduction type electron-emitting device according to the invention.

FIG. 3 is a schematic block diagram of a gauging system for determining the performance of an electron-emitting device having a configuration as illustrated in FIGS. 1A and 1B. In FIG. 3, the device comprises a substrate 1, a pair of device electrodes 5 and 6, a thin film 4 including an electron-emitting region 3. Otherwise, the gauging system comprises an ammeter 30 for metering the device current If running through the thin film 4 including the electron-emitting region 3 between the device electrodes 5 and 6, a power source 31 for applying a device voltage Vf to the device, an anode 34 for capturing the emission current Ie emitted from the electron-emitting region of the device, a high voltage source 33 for applying a voltage to the anode 34 of the gauging system and another ammeter 32 for metering the emission current Ie emitted from the electron-emitting region 3 of the device.

For measuring the device current If and the emission current Ie, the device electrodes 5 and 6 are connected to the power source 31 and the ammeter 30 and the anode 34 is placed above the device and connected to the power source 33 by way of the ammeter 32. The electron-emitting device to be tested and the anode 34 are put into a vacuum chamber, which is provided with an exhaust pump, a vacuum gauge and other pieces of equipment necessary to operate a vacuum chamber so that the metering operation can be conducted under a desired vacuum condition. The exhaust pump may be provided with an ordinary high vacuum system comprising a turbo pump or a rotary pump or an oil-free high vacuum system comprising an oil-free pump such as a magnetic levitation turbo pump or a dry pump and an ultra-high vacuum system comprising an ion pump.

The vacuum chamber of the gauging system is connected to an ampoule or a gas bomb containing one or more than one organic substance by way of a needle valve so that the operation of activation may be carried out in the vacuum chamber, feeding the organic substances in gaseous form into the vacuum chamber. The feed rate may be regulated by controlling the needle valve and the exhaust pump, monitoring the degree of vacuum in the chamber by means of a vacuum gauge.

The vacuum chamber and the substrate of the electron source can be heated to approximately 200° C. by means of a heater (not shown).

For determining the performance of the device, a voltage between 1 and 10 KV is applied to the anode, which is spaced apart from the electron-emitting device by distance H which is between 2 and 8 mm.

For the forming operation, a constant pulse voltage or an increasing pulse voltage may be applied. The operation of using a constant pulse voltage will be described first by referring to FIG. 4A, showing a pulse voltage having a constant pulse height.

Figure 4A:
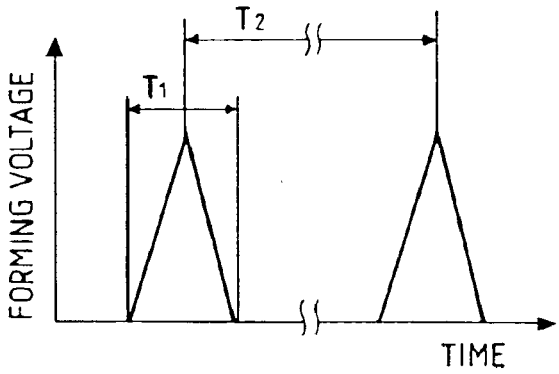
FIGS. 4A through 4C are graphs showing voltage waveforms observed during an electrically energizing process conducted on a surface conduction electron-emitting device according to the invention.

In FIG. 4A, the pulse voltage has a pulse width T1 and a pulse interval T2, which are between 1 and 10 microseconds and between 10 and 100 milliseconds respectively. The height of the triangular wave (the peak voltage for the electric forming operation) may be appropriately selected so long as the voltage is applied in vacuum.

Figure 4B:
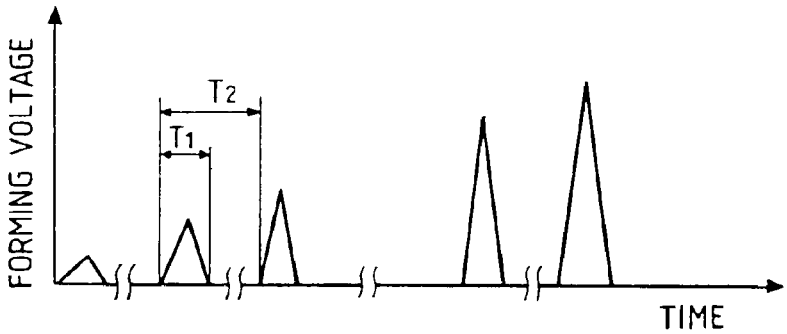

FIG. 4B shows a pulse voltage whose pulse height increases with time. In FIG. 4B, the pulse voltage has an width T1 and a pulse interval T2, which are between 1 and 10 microseconds and between 10 and 100 milliseconds respectively. The height of the triangular wave (the peak voltage for the electric forming operation) is increased at a rate of, for instance, 0.1 V per step in vacuum.

The electric forming operation will be terminated when typically a resistance greater than 1 M ohms is observed for the device current running through the thin film 2 for forming an electron-emitting region while applying a voltage of approximately 0.1 V is applied to the device electrodes to locally destroy or deform the thin film. The voltage observed when the electric forming operation is terminated is referred to as the forming voltage Vf.

While a triangular pulse voltage is applied to the device electrodes to form an electron-emitting region in an electric forming operation as described above, the pulse voltage may have a different waveform such as rectangular and the pulse width and the pulse interval may be of values other than those cited above so long as they are selected as a function of the device resistance and other values that meet the requirements for forming an electron-emitting region. Additionally, since the forming voltage is unequivocally defined in terms of the material and the configuration of the device and other related factors, it is preferable to apply a pulse voltage having an increasing wave height rather than to apply a pulse voltage with a constant wave height because a desired energy level may be easily selected for each device to give rise to desired electron emission characteristics for the device.

Figure 5:
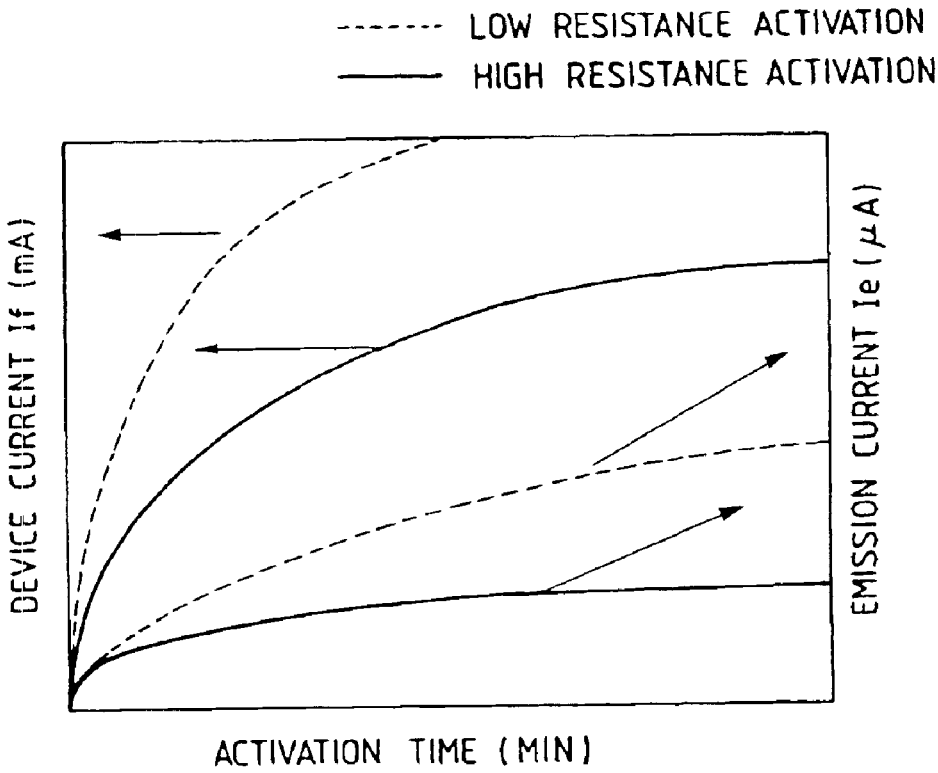
FIG. 5 is a graph showing the relationship between the device current and the time of activation process.

4) After the electric forming operation, the device is subjected to an activation process, where a pulse voltage having a constant wave height is repeatedly applied to the device in vacuum of a desired degree as in the case of the forming operation so that carbon and/or carbon compounds may be deposited on the device out of the organic substances existing in the vacuum in order to cause the device current If and the emission current Ie of the device to change markedly (hereinafter referred to as activation process). Organic substances can be supplied into vacuum by arranging in the turbo pump or the rotary pump containing the organic substances in such a way that the organic substances are also held in vacuum or, preferably, by feeding one or more than one predetermined carbon compounds into the vacuum chamber containing the device but not any oil. Carbon compounds to be fed into the vacuum chamber are preferably organic substances. The activation process is terminated when the emission current Ie gets to a saturation point while gauging the device current If and the emission current Ie. FIG. 5 typically shows how the device current If and the emission current Ie are dependent on the duration of the activation process. It should also be noted that, in the activation process, the time dependency of the device current If and the emission current Ie varies as a function of the degree of vacuum and the pulse voltage applied to the device and that the contour and the state of the deformed or transformed portion of the thin film depend on how the forming process is carried out. In FIG. 5, the time dependency of the device current If and the emission current Ie is illustrated for a typical high resistance activation process and a typical low resistance activation process. In either case, it will be seen that the emission current Ie increases with the duration of the activation process so that the device may eventually reach a level of emission current Ie required for its application.

Organic substances that can suitably be used for the purpose of the invention show a vapor pressure greater 0.2 hPa and smaller than 5,000 hPa and preferably greater than 10 hPa and smaller than 5,000 hPa at temperature where they are effectively adsorbed by the area 3 of the device that has been deformed or transformed in the forming process.

The activation process is preferably conducted at room temperature from the viewpoint of feeding organic substances and controlling the temperature of the device.

If the activation process is conducted at 20° C., organic substances that can suitably be used for the purpose of the invention needs to show a vapor pressure greater than 0.2 hPa and smaller than 5,000 hPa.

Organic substances that can be used for the purpose of the invention include aliphatic hydrocarbons such as alkanes, alkenes and alkynes, aromatic hydrocarbons, alcohols, aldehydes, ketones, amines and organic acids such as phenylic acids, carbonic acids and sulfonic acids as well as their derivatives that may produce a required vapor pressure.

Some specific organic substances to be suitably used for the purpose of the invention includes butadiene, n-hexane, 1-hexane, benzene, toluene, o-xylene, benzonitrile, chloroethylene, trichloroethylene, methanol, ethanol, isopropyl alcohol, formaldehyde, acetaldehyde, propanol, acetone, ethyl methyl ketone, diethyl ketone, methyl amine, ethyl amine, ethylene diamine, phenol, formic acid, acetic acid and propionic acid.

The activation process may become excessively time consuming and not practical for an electron-emitting device according to the invention, if the vapor pressure of organic substances exceeds 5,000 hPa at 20° C. in the vacuum chamber.

If, on the other hand, the vapor pressure of organic substances in the vacuum chamber falls under 0.2 hPa at 20° C. in the vacuum chamber, the operation of depositing additional carbon and/or carbon compounds in Step 5) described below becomes impracticable and the device current If and the emission current Ie may have difficulty to get to a constant level. If such is the case, the emission current may become variable as the pulse width of the drive voltage for driving the device changes (a phenomenon to be referred to pulse width dependency hereinafter). This phenomenon may be attributable to the adsorption residue of the organic substances such as ingredients of oil left on an area in and near the electron-emitting region of the device that becomes hardly removable after the activation process. Once such a phenomenon becomes existent, so-called pulse modulation or the technique of controlling the rate of electron emission of an electron-emitting device by controlling the pulse width of the pulse voltage applied to the device and hence gradated display of images on a display medium comprising electron-emitting devices arranged in the form of simple matrix (as will described hereinafter) will not be feasible any longer.

If, additionally, a large number of electron-emitting devices are arranged in a narrow space as in the case of a flat type display panel as will be described hereinafter, highly adsorbable organic substances such as ingredients of oil to be used for activation can hardly be distributed evenly within the narrow space nor removed after the activation process so that the pulse-width dependency of the devices may be adversely affected.

For the above described reasons, the vapor pressure of the organic substances in the activation process is preferably between 0.2 hPa and 5,000 hPa at 20° C.

The feeding partial pressure of the organic substances is preferably between $10^{-2}$ and $10^{-7}$ torr when an ordinary exhaust device is used.

Assuming that the vapor pressure of the organic substances is PrO and the feeding partial pressure is Pr, the feeding partial pressure Pr is preferably greater than PrO× $10^{-8}$ and determined as a function of the organic substances involved.

If the feeding partial pressure of the organic substances is lower than the above level, the activation process may become excessively time consuming and not practical for an electron-emitting device according to the invention.

The activation process is referred to as a high resistance activation process when the pulse voltage used in the process is sufficiently high relative to the forming voltage Vform, whereas it is referred to as a low resistance activation process when the pulse voltage used in the process is sufficiently low relative to the forming voltage Vform. More specifically, the initial voltage Vp that indicates the voltage controlled negative resistance of the device as defined hereinafter provides a reference for the above distinction. Note that electron-emitting devices activated by a high resistance activation process are preferable than those activated by a low resistance activation process from the viewpoint of performance. More specifically, the activation process is preferably conducted on an electron-emitting device according to the invention with the operating voltage of the device.

Figure 6A:
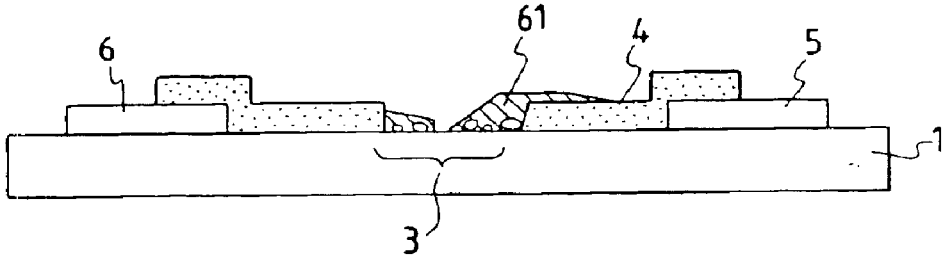
FIGS. 6A and 6B are schematic sectional views showing an embodiment of surface conduction electron-emitting device according to the invention before and after an activation process respectively.
Figure 6B:
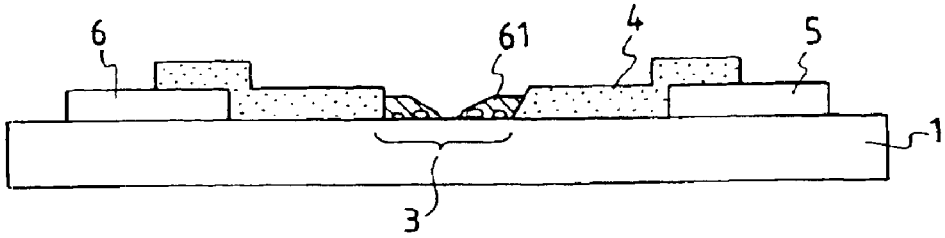

FIGS. 6A and 6B schematically illustrate how an electron-emitting device according to the invention is treated in the high and low resistance activation processes when observed through an FESEM or TEM. FIGS. 6A and 6B respectively show schematic cross sectional views of a device treated by a high resistance activation process and a low resistance activation process. In a high resistance activation process (FIG. 6A), carbon and/or carbon compounds are remarkably deposited on the high potential side of the device partly beyond the area 3 deformed or transformed by electric forming, whereas they are only slightly deposited on the low potential side of the device. When observed through a microscope having large magnifying power, a deposit of carbon and/or carbon compounds is found on and near some of the fine particles of the device and, in some cases, even on the device electrodes if the electrodes are located relatively close to each other. The thickness of the film deposit is preferably less than 500 angstroms and more preferably less than 3,000 angstroms.

When observed through a TEM or Raman microscope, it is found that the deposited carbon and/or carbon compounds are mostly graphite (both mono- and poly-crystalline) and non-crystalline carbon (or a mixture of non-crystalline carbon and poly-crystalline graphite).

In a low resistance activation process (FIG. 6B), on the other hand, a deposit of carbon and/or carbon compounds is found only in the area 3 that has been deformed or transformed by electric forming. When observed through a microscope having large magnifying power, a deposit of carbon and/or carbon compounds is also found on and near some of the fine particles of the device.

FIG. 5 shows that a low resistance activation process makes both the device and emission currents of a device according to the invention higher than a high resistance activation process.

5) An electron-emitting device that has been treated in an electric forming process and an activation process is then driven to operate in a vacuum of a degree higher than that of the activation process. Here, a vacuum of a degree higher than that of the activation process means a vacuum of a degree greater than $10^{-6}$ and, preferably, an ultra-high vacuum where no carbon nor carbon compounds can be additionally deposited on the device.

Thus, no carbon nor carbon compounds would be deposited thereafter, to establish stable device and emission currents If and Ie.

Now, some of the basic features of an electron-emitting device according to the invention and prepared in the above described manner will be described below by referring to FIG. 7.

Figure 7:
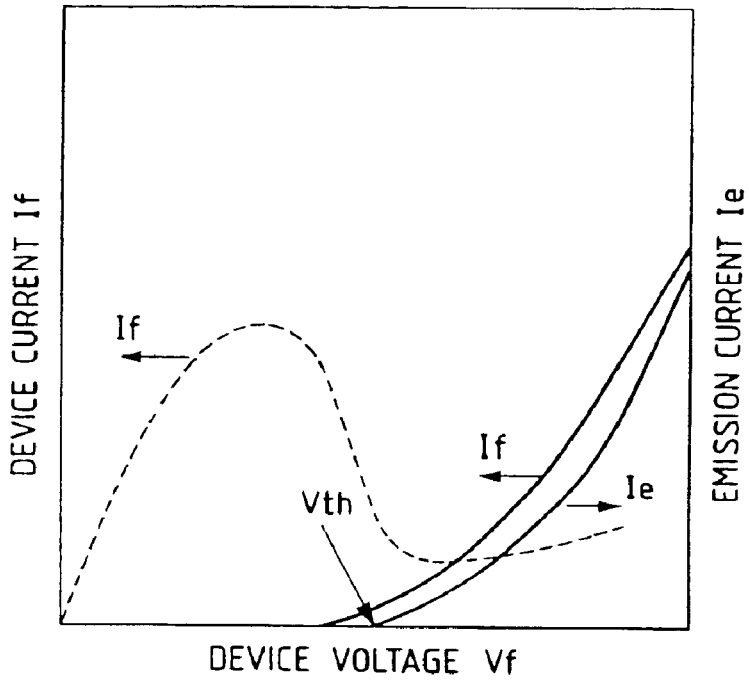
FIG. 7 is a graph showing the relationship between the device voltage and the device current as well as the relationship between the device voltage and the emission current of an embodiment of surface conduction electron-emitting device according to the invention.

FIG. 7 shows a graph schematically illustrating the relationship between the device voltage Vf and the emission current Ie and the device current If typically observed by the gauging system of FIG. 3. Note that different units are arbitrarily selected for Ie and If in FIG. 7 in view of the fact that Ie has a magnitude by far smaller than that of If. As seen in FIG. 7, an electron-emitting device according to the invention has three remarkable features in terms of emission current Ie, which will be described below.

Firstly, an electron-emitting device according to the invention shows a sudden and sharp increase in the emission current Ie when the voltage applied thereto exceeds a certain level (which is referred to as a threshold voltage hereinafter and indicated by Vth in FIG. 7), whereas the emission current Ie is practically undetectable when the applied voltage is found lower than the threshold value Vth. Differently stated, an electron-emitting device according to the invention is a non-linear device having a clear threshold voltage Vth to the emission current Ie.

Secondly, since the emission current Ie is highly dependent on the device voltage Vf, the former can be effectively controlled by way of the latter.

Thirdly, the emitted electric charge captured by the anode 34 is a function of the duration of time of application of the device voltage Vf. In other words, the amount of electric charge captured by the anode 34 can be effectively controlled by way of the time during which the device voltage Vf is applied.

Because of the above remarkable features, it will be understood that the electron-emitting behavior of an electron source comprising a plurality of electron-emitting devices according to the invention and hence that of an image-forming apparatus incorporating such an electron source can easily be controlled in response to the input signal. Thus, such an electron source and an image-forming apparatus may find a variety of applications.

On the other hand, the device current If either monotonically increases relative to the device voltage Vf (as shown by a solid line in FIG. 7, a characteristic referred to as MI characteristic hereinafter) or changes to show a form specific to a voltage-controlled-negative-resistance characteristic (as shown by a broken line in FIG. 5, a characteristic referred to as VCNR characteristic hereinafter). These characteristics of the device current are dependent on a number of factors including the manufacturing method, the conditions where it is gauged and the environment for operating the device. The critical voltage for the VCNR characteristic to become apparent is referred to as the boundary voltage VP.

Thus, it has been discovered that the VCNR characteristic of the device current If varies remarkably as a function of a number of factors including the electric conditions of the electric forming process, the vacuum conditions of the vacuum system, the vacuum and electric conditions of the gauging system particularly when the performance of the electron-emitting device is gauged in the vacuum gauging system after the electric forming process (e.g., the sweep rate at which the voltage being applied to the electron-emitting device is swept from low to high in order to determine the current-voltage characteristic of the device) and the duration of time for the electron-emitting device to have been left in the vacuum system before the gauging operation, although the device current of the electron-emitting device never loses the above identified three features.

Now, an electron source according to the invention will be described.

An electron source and hence an image-forming apparatus can be realized by arranging a plurality of electron-emitting devices according to the invention on a substrate. Electron-emitting devices may be arranged on a substrate in a number of different modes. For instance, a number of surface conduction electron-emitting devices as described earlier by referring to a light source may be arranged in rows along a direction (hereinafter referred to row-direction), each device being connected by wirings at opposite ends thereof, and driven to operate by control electrodes (hereinafter referred to as grids or modulation means) arranged in a space above the electron-emitting devices along a direction perpendicular to the row direction (hereinafter referred to as column-direction), or, alternatively as described below, a total of m X-directional wiring and a total of n Y-directional wirings are arranged with an interlayer insulation layer disposed between the X-directional wirings and the Y-directional wiring along with a number of surface conduction electron-emitting devices such that the pair of device electrodes of each surface conduction electron-emitting device are connected respectively to one of the X-directional wiring and one of the Y-directional wirings. The latter arrangement is referred to as a simple matrix arrangement. Now, the simple matrix arrangement will be described in detail.

In view of the three basic features of a surface conduction electron-emitting device according to the invention, each of the surface conduction electron-emitting devices having a simple matrix arrangement configuration can be controlled for electron emission by controlling the wave height and the pulse width of the pulse voltage applied to the opposite electrodes of the device above the threshold voltage level. On the other hand, the device does not emit any electrons below the threshold voltage level. Therefore, regardless of the number of electron-emitting devices, desired surface conduction electron-emitting devices can be selected and controlled for electron emission in response to the input signal by applying a pulse voltage to each of the selected devices.

Figure 8:
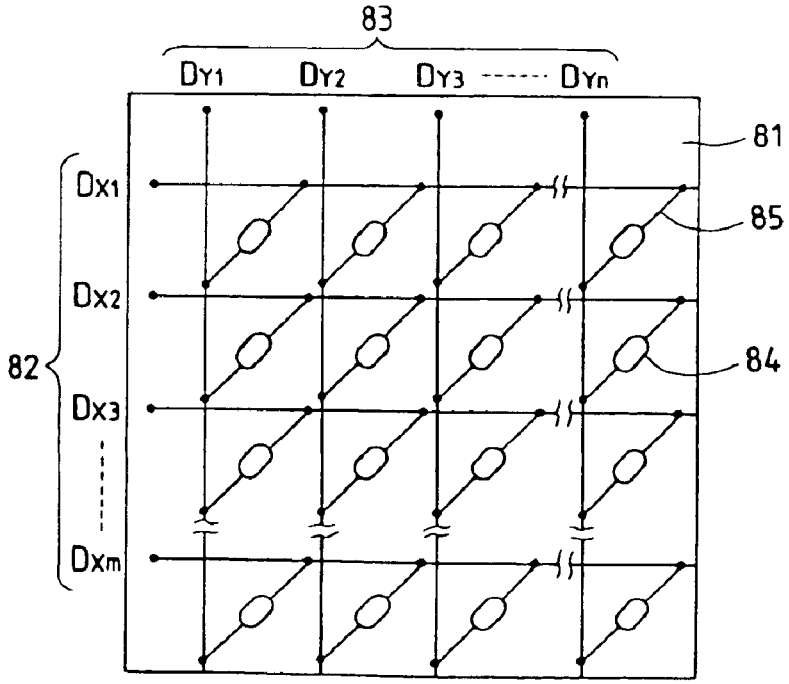
FIG. 8 is a schematic plan view of the substrate of an embodiment of electron source according to the invention used in Example 2 as described hereinafter, showing in particular the simple matrix configuration of the substrate.

FIG. 8 is a schematic plan view of the substrate of an electron source according to the invention ealized by using the above feature. In FIG. 8, the electron source comprises a substrate 81, X-directional wirings 82, Y-directional wirings 83, surface conduction electron-emitting devices 84 and connecting wires 85. The surface conduction electron-emitting devices may be either of the flat type or of the step type.

In FIG. 8, the substrate 81 of the electron source may be a glass substrate and the number and configuration of the surface conduction electron-emitting devices arranged on the substrate may be appropriately determined depending on the application of the electron source.

There are provided a total of m X-directional wirings 82, which are denoted by DX1, DX2, . . . , DXm and made of a conductive metal formed by vacuum deposition, printing or sputtering. These wirings are so designed in terms of material, thickness and width that, if necessary, a substantially equal voltage may be applied to the surface conduction electron-emitting devices. A total of n Y-directional wirings are arranged and denoted by DY1, DY2, . . . , DYn, which are similar to the X-directional wirings in terms of material, thickness and width. An interlayer insulation layer (not shown) is disposed between the m X-directional wirings and the n Y-directional wirings to electrically isolate them from each other, the m X-directional wirings and n Y-directional wirings forming a matrix (m and n are integers).

The interlayer insulation layer (not shown) is typically made of $SiO_2$ and formed on the entire surface or part of the surface of the insulating substrate 81 to show a desired contour by means of vacuum deposition, printing or sputtering. The thickness, material and manufacturing method of the interlayer insulation layer are so selected as to make it withstand any potential difference between an X-directional wiring 82 and a Y-directional wiring 83 at the crossing thereof. Each of the X-directional wirings 82 and the Y-directional wirings 83 is drawn out to form an external terminal.

The oppositely arranged electrodes (not shown) of each of the surface conduction electron-emitting devices 84 are connected to the related one of the m X-directional wirings 82 and the related one of the n Y-directional wirings 83 by respective connecting wires 85 which are made of a conductive metal and formed by vacuum deposition, printing or sputtering.

The electroconductive metal material of the device electrodes and that of the connecting wires 85 extending from the m X-directional wirings 82 and the n Y-directional wirings 83 may be the same or contain common elements as ingredients, the latter being appropriately selected depending on the former. If the device electrodes and the connecting wires are made of a same material, they may be collectively called device electrodes without discriminating the connecting wires. The surface conduction electron-emitting devices may be arranged directly on the substrate 81 or on the interlayer insulation layer (not shown).

The X-directional wirings 82 are electrically connected to a scan signal generating means (not shown) for applying a scan signal to a selected row of surface conduction electron-emitting devices 84 and scanning the selected row according to an input signal.

On the other hand, the Y-directional wirings 83 are electrically connected to a modulation signal generating means (not shown) for applying a modulation signal to a selected column of surface conduction electron-emitting devices 84 and modulating the selected column according to an input signal.

Note that the drive signal to be applied to each surface conduction electron-emitting device is expressed as the voltage difference of the scan-signal and the modulation signal applied to the device.

Figure 9:
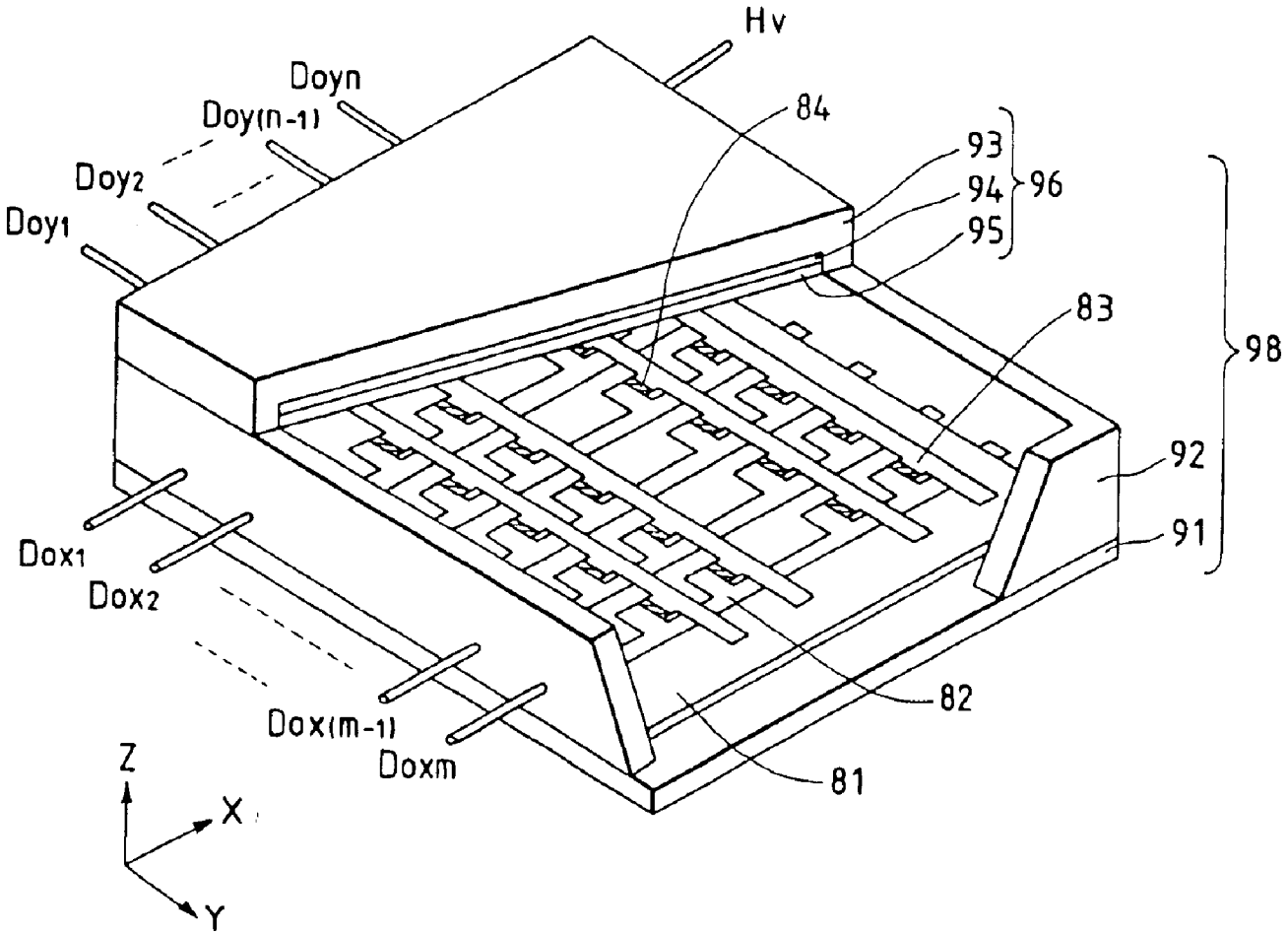
FIG. 9 is a schematic perspective view of the substrate of the embodiment of electron source of FIG. 8.

Now, an image-forming apparatus according to the invention and comprising an electron source having a simple matrix arrangement as described above will be described by referring to FIG. 9 and FIGS. 10A and 10B. This apparatus may be a display apparatus. Referring firstly to FIG. 9 illustrating the basic configuration of the display panel of the image-forming apparatus, it comprises an electron source substrate 81 of the above described type, a rear plate 91 rigidly holding the electron source substrate 81, a face plate 96 produced by laying a fluorescent film 94 and a metal back 95 on the inner surface of a glass substrate 93 and a support frame 92. An enclosure 98 is formed for the apparatus as frit glass is applied to said rear plate 91, said support frame 92 and said face plate 96, which are subsequently baked to 400 to 500° C. in the atmosphere or in nitrogen and bonded together.

In FIG. 9, reference numeral 84 denotes the electron-emitting region of each electron-emitting device and reference numerals 82 and 83 respectively denotes the X-directional wiring and the Y-directional wiring connected to the respective device electrodes of each electron-emitting device.

While the enclosure 98 is formed of the face plate 96, the support frame 92 and the rear plate 91 in the above described embodiment, the rear plate 91 may be omitted if the substrate 81 is strong enough by itself. If such is the case, an independent rear plate 91 may not be required and the substrate 81 may be directly bonded to the support frame 92 so that the enclosure 98 is constituted of a face plate 96, a support frame 92 and a substrate 81. The overall strength of the enclosure 98 may be increased by arranging a number of support members called spacers (not shown) between the face plate 96 and the rear plate 91.

Figure 10A:
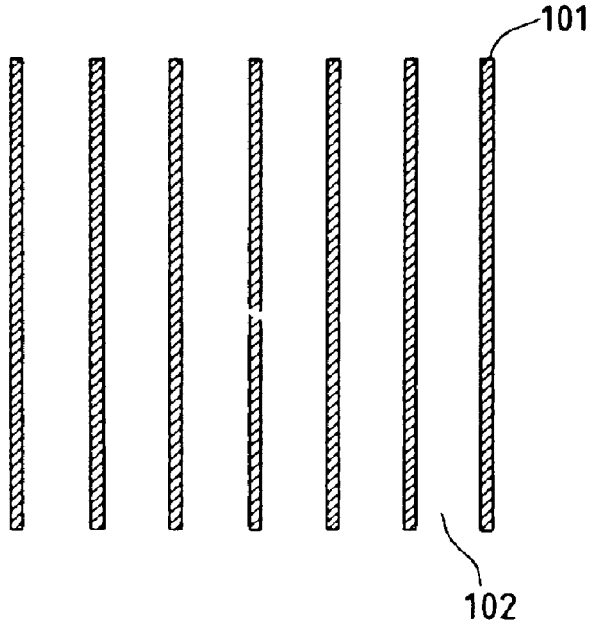
FIGS. 10A and 10B are enlarged schematic plan views of two different fluorescent layers that can be used alternatively for the embodiment of FIG. 8.
Figure 10B:
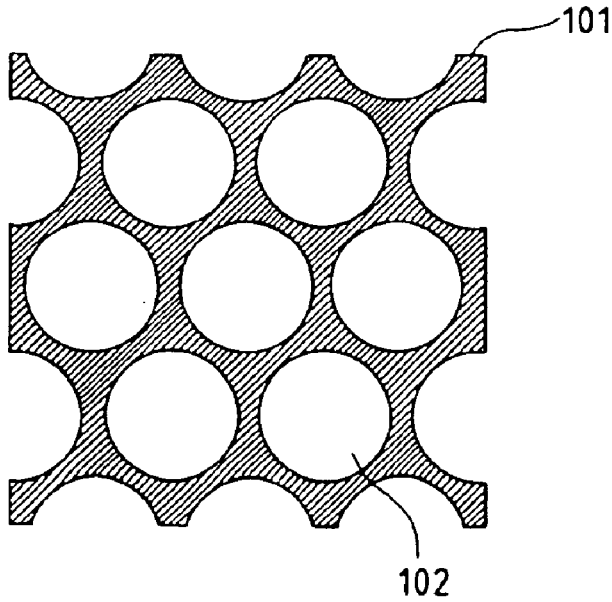

FIGS. 10A and 10B schematically illustrate two possible arrangements of fluorescent bodies to form a fluorescent film 94. While the fluorescent film 94 comprises only fluorescent bodies if the display panel is used for showing black and white pictures, it needs to comprise for displaying color pictures black conductive members 101 and fluorescent bodies 102, of which the former are referred to as black stripes or members of a black matrix depending on the arrangement of the fluorescent bodies. Black stripes or members of a black matrix are arranged for a color display panel so that the fluorescent bodies 102 of three different primary colors are made less discriminable and the adverse effect of reducing the contrast of displayed images of external light is weakened by blackening the surrounding areas. While graphite is normally used as a principal ingredient of the black stripes, other conductive material having low light transmissivity and reflectivity may alternatively be used.

A precipitation or printing technique can suitably be used for applying a fluorescent material on the glass substrate regardless of black and white or color display.

An ordinary metal back 95 is arranged on the inner surface of the fluorescent film 94. The metal back 95 is provided in order to enhance the luminance of the display panel by causing the rays of light emitted from the fluorescent bodies and directed to the inside of the enclosure to turn back toward the face plate 96, to use it as an electrode for applying an accelerating voltage to electron beams and to protect the fluorescent bodies against damage that may be caused when negative ions generated inside the enclosure collide with them. It is prepared by smoothing the inner surface of the fluorescent film 94 (in an operation normally called "filming") and forming an Al film thereon by vacuum deposition after forming the fluorescent film 94.

A transparent electrode (not shown) may be formed on the face plate 96 facing the outer surface of the fluorescent film 94 in order to raise the conductivity of the fluorescent film 94.

Care should be taken to achieve accurate alignment of each set of color fluorescent bodies and an electron-emitting device, if a color display is involved, before the above listed components of the enclosure are bonded together.

The enclosure 98 is then evacuated by way of an exhaust pipe (not shown) to a degree of vacuum of approximately $10^{-6}$ and hermetically sealed.

After evacuating the enclosure to a desired degree of vacuum by way of an exhaust pipe (not shown), a voltage is applied to the device electrodes of each device by way of external terminals Dx1 through Dxm and Dy1 through Dyn for a forming operation and then desired organic substances are fed in under a vacuum condition for an activation process in order to produce an electron-emitting region 3 of the device.

Most preferably, a baking operation is carried out at 80° C. to 200° C. for 3 to 15 hours, during which the vacuum system in the enclosure is switched to an ultra-high vacuum system comprising an ion pump or the like. The switch to an ultra-high vacuum system and the baking operation are intended to ensure the surface conduction electron-emitting device a satisfactorily monotonically increasing characteristic (MI characteristic) for both the device current If and the emission current Ie, and, therefore, this objective may be achieved by some other means under different conditions. A getter operation may be carried out after sealing the enclosure 98 in order to maintain that degree of vacuum in it. A getter operation is an operation of heating a getter (not shown) arranged at a given location in the enclosure 98 immediately before or after sealing the enclosure 98 by resistance heating or high frequency heating to produce a vapor deposition film. A getter normally contains Ba as a principle ingredient and the formed vapor deposition film can typically maintain the inside of the enclosure to a degree of $1\times10^{-5}$ to $10^{-7}$ Torr by its adsorption effect.

An image-forming apparatus according to the invention and having a configuration as described above is operated by applying a voltage to each electron-emitting device by way of the external terminal Dox1 through Doxm and Doy1 through Doyn to cause the electron-emitting devices to emit electrons. Meanwhile, a high voltage is applied to the metal back 85 or the transparent electrode (not shown) by way of high voltage terminal Hv to accelerate electron beams and cause them to collide with the fluorescent film 94, which by turn is energized to emit light to display intended images.

While the configuration of a display panel to be suitably used for an image-forming apparatus according to the invention is outlined above in terms of indispensable components thereof, the materials of the components are not limited to those described above and other materials may appropriately be used depending on the application of the apparatus. Input signals for the above image-forming apparatus are not limited to NTSC signals, and signals in other ordinary television systems such as PAL and SECAM and those of television systems with a greater number of scanning lines (such as MUSE and other high definition systems) may be made compatible with the apparatus.

The basic idea of the present invention may be utilized to provide not only display apparatuses for television but also those for television conferencing, computer systems and other applications. Additionally, an image-forming apparatus to be used for an optical printer comprising a photosensitive drum may be realized on the basis of the present invention.

EXAMPLES

Now, the present invention will be described in greater detail by way of examples.

Example 1

Figure 11:
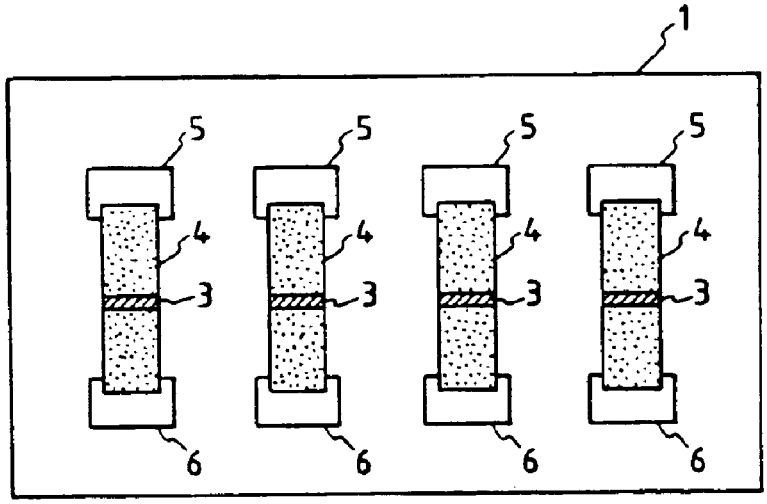
FIG. 11 is a plan view of the electron source used in Example 1 as described hereinafter.

Device specimens used in this example had a basic configuration the same as the one illustrated in the plan view of FIG. 1A and the sectional view of FIG. 1B. Four identical devices were formed on a substrate 1. Note that the reference numerals in FIG. 11 denote respective components identical with those of FIGS. 1A and 1B.

The method of manufacturing the devices was basically same as the one illustrated in FIGS. 2A through 2C. The basic configuration of the device specimen and the method for manufacturing the same will be described below by referring to FIGS. 1A and 1B and FIGS. 2A through 2C.

Referring to FIGS. 1A and 1B, the prepared specimens of electron-emitting device comprised a substrate 1, a pair of device electrodes 5 and 6, a thin film 4 including an electron-emitting region 3.

The method used for manufacturing the devices will be described below in terms of an experiment conducted for the specimens, referring to FIGS. 1A and 1B and FIGS. 2A through 2C.

Step A:

After thoroughly cleansing of a soda lime glass plate, a silicon oxide film was formed thereon to a thickness of 0.5 micron by sputtering to produce a substrate 1, on which a pattern of photoresist (RD-2000N-41: available from Hitachi Chemical Co., Ltd.) was formed for a pair of device electrodes 5 and 6, and a gap G separating the electrodes and then Ti and Ni were sequentially deposited thereon respectively to thicknesses of 50 Å and 1,000 Å by vacuum deposition. The photoresist pattern was dissolved by an organic solvent and the Ni/Ti deposit film was treated by using a lift-off technique to produce a pair of device electrodes 5 and 6 having a width W1 of 300 microns and separated from each other by a distance L1 of 3 microns.

Step B:

A Cr film was formed to a film thickness of 1,000 Å by vacuum deposition, which was then subjected to a patterning operation. Thereafter, organic Pd (ccp4230: available from Okuno Pharmaceutical Co., Ltd.) was applied to the Cr film by means of a spinner, while rotating the film, and baked at 300° C. for 10 minutes to produce a thin film 2 for forming an electron-emitting region, which was made of fine particles containing Pd as a principal ingredient and had a film thickness of 100 angstroms and an electric resistance per unit area of $2\times10^4$ Ω/□. Note that the term "a fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is that of recognizable fine particles arranged in any of the above described states.

Step C:

The Cr film and the baked thin film 2 for forming an electron-emitting region were etched by using an acidic etchant to produce a desired pattern.

Now, a pair of device electrodes 5 and 6 and a thin film 2 for forming an electron-emitting region were produced on the substrate 1.

Step D:

Then, a gauging system as illustrated in FIG. 3 was set in position, and the inside was evacuated by means of an exhaust pump to a degree of vacuum of $2\times10^{-5}$ torr. Subsequently, a voltage was applied to the device electrodes 5, 6 for electrically energizing the device (electric forming process) by the power source 31 provided there for applying a device voltage Vf to the device. FIG. 4B shows the waveform of the voltage used for the electric forming process.

In FIG. 4B, T1 and T2 respectively denote the pulse width and the pulse interval of the applied pulse voltage, which were respectively 1 millisecond and 10 milliseconds for the experiment. The wave height (the peak voltage for the forming operation) of the applied pulse voltage was increased stepwise with a step of 0.1 V. During the forming operation, a resistance measuring pulse voltage of 0.1 V was inserted during each T2 to determine the current resistance of the device. The forming operation was terminated when the gauge for the resistance measuring pulse voltages showed a reading of resistance of approximately 1 M ohms. In the experiment, the reading of the gauge for the forming voltage Vform was 5.1 V, 5.0 V, 5.0V and 5.15 V.

Step E:

Two pairs of devices that had undergone a forming process were subjected to an activation process, where voltages having a rectangular waveform (FIG. 4C) with wave heights of 4 V and 14 V were respectively applied to each pair of devices. Hereinafter, the specimens subjected to a low resistance activation process with 4 V will be referred to as devices A, whereas the specimens subjected to a high resistance activation process with 14 V will be referred to as devices B. In the activation process, the above described pulse voltages were applied to the device electrodes of the respective devices in the gauging system of FIG. 3, while observing the device current If and the emission current Ie. The degree of vacuum in the gauging system of FIG. 3 was $1.5\times10^{-5}$ torr. The activation process continued for 30 minutes for each device.

An electron-emitting region 3 was then formed on each of the devices to produce a complete electron-emitting device.

In an attempt to see the properties and the profile of the surface conduction electron-emitting devices prepared through the preceding steps, a device A and a device B were observed for electron-emitting performance, using a gauging system as illustrated in FIG. 3. The remaining pair of devices were observed through a microscope.

In the above observation, the distance between the anode and the electron-emitting device was 4 mm and the potential of the anode was 1 kV, while the degree of vacuum in the vacuum chamber of the system was held to $1\times10^{-6}$ torr throughput the gauging operation. A device voltage of 14 V was applied between the device electrodes 5, 6 of each of the devices A and B to see the device current If and the emission current Ie under that condition. A device current If of approximately 10 mA began to flow through the device A immediately after the start of measurement but the current gradually declined and the emission current Ie also showed a decline. On the other hand, a steady flow was observed for both the device current If and the emission current Ie in the device B from the start of measurement. A device current If of 2.0 mA and an emission current Ie of 1.0 $\mu$A were observed for a device voltage of 14 V to provides an electron emission efficiency $\theta$=Ie/If(%) of 0.05%. Thus, it will be seen that the device A showed a large and unstable device current If in the initial stages of measurement whereas the device B proved to be stable and have an excellent electron emission efficiency $\theta$ from the very start of measurement.

When the degree of vacuum in the activation process was held to be $1.5\times10^{-5}$ torr for a device B and the device current If and the emission current Ie were observed, sweeping the device with a triangular pulse voltage with a frequency of approximately 0.005 Hz, the device current If was such as indicated by the broken line in FIG. 7. As seen from FIG. 7, the device current If monotonically increased to approximately 5 V and then showed a voltage-controlled-negative-resistance above the 5 V level. The device voltage at which the device current If reaches a peak is referred to VP, which was 5 V for the specimen. It should be noted that the device current If was reduced to a fraction of the maximum device current or approximately 1 mA beyond 10 V.

When observed through a microscope, the devices A and B showed profiles similar to those illustrated in FIGS. 6B and 6A respectively. From a comparison between FIG. 6B and FIG. 6A, it was found that the device A carried a coat formed in the area of the thin film between the device electrodes that had been transformed, while in case of the device B, a coat was formed mainly on the high potential side from part of the transformed area along the direction along which a voltage was applied to the device in the activation process. When observed through an FESEM having large magnifying power, it was found that the coat existed around part of the fine metal particles and in part of the inter-particle space of the device.

When observed through a TEM or a Raman microscope, it was found that the coat was made of graphite and amorphous carbon.

From these observations, it may be safe to say that carbon was produced in the area of the thin film of the device A that had been transformed by the forming process as the area was activated by a voltage below the voltage level of Vp required for voltage-controlled-negative-resistance as described above so that the carbon coat formed between the high and low potential sides of the transformed area of the thin film provided a current path for the device current through which a large device current was allowed to flow at a rate several times greater than the device current of the device B from the very beginning.

Contrary to this, the device B was activated by a voltage above the voltage level of Vp required for voltage-controlled-negative-resistance in a high resistance activation process so that, if a carbon coat had been formed, it may have been electrically disrupted to ensure a stable device current to flow fro the beginning.

Thus, an electron-emitting device having a device current If and a emission current Ie that are stable and capable of efficiently emitting electron can be prepared by a high resistance activation process.

Example 2

In this example, a large number of surface conduction electron-emitting devices were arranged to a simple matrix arrangement to produce an image-forming apparatus.

Figure 13:
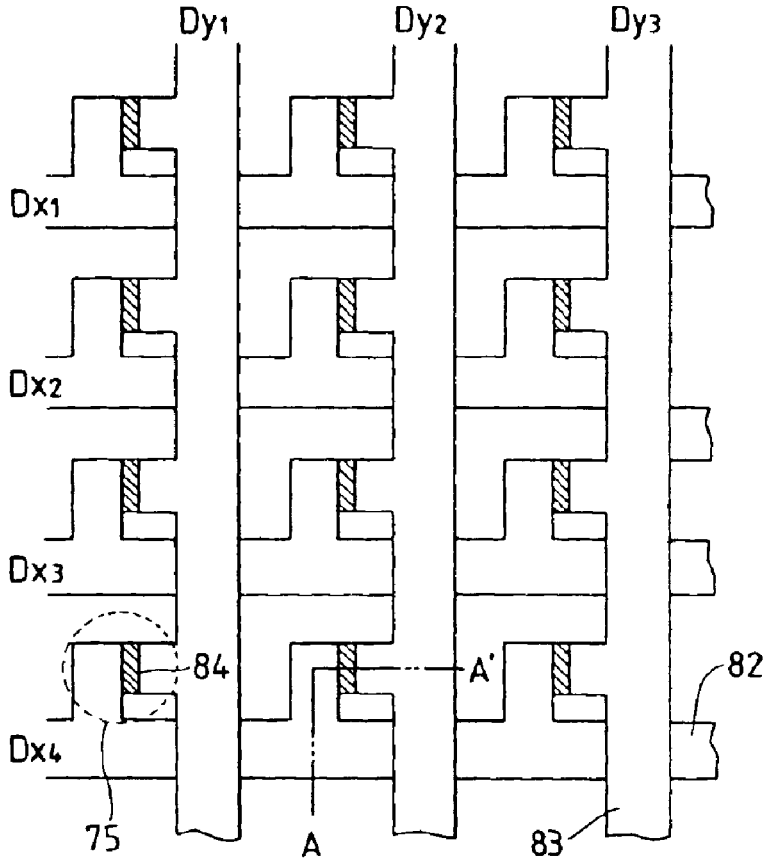
FIG. 13 is an enlarged schematic partial plan view of the substrate of the electron source of an embodiment of image-forming apparatus according to the invention used in Example 2 as described hereinafter.
Figure 14:
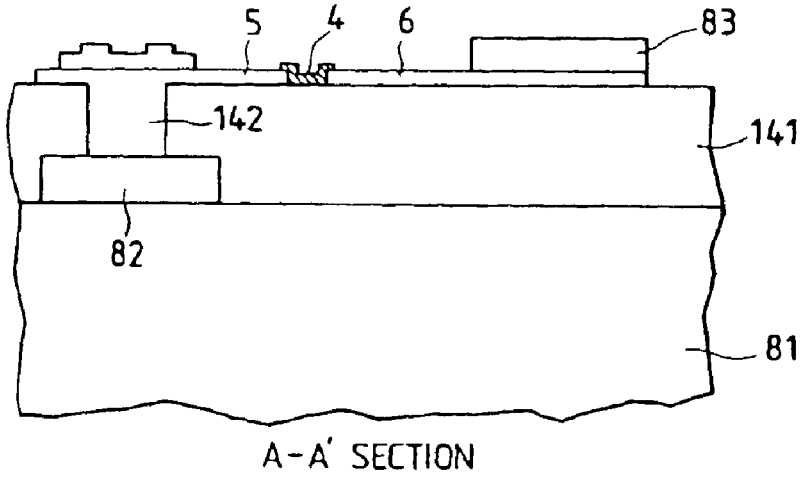
FIG. 14 is an enlarged schematic sectional side view of the substrate of FIG. 13 taken along line A–A'.

FIG. 13 is an enlarged schematic partial plan view of the substrate of the electron source of the apparatus. FIG. 14 is an enlarged schematic sectional side view of the substrate of FIG. 13 taken along line A–A'. Note that reference symbols in FIGS. 13, 14, 15A through 15D and 16A though 16D respectively denote identical items throughout the drawings. Thus, reference numerals 81, 82 and 83 respectively denote a substrate, an X-directional wiring corresponding to an external terminal Dxm (also referred to as a lower wiring) and a Y-direction wiring corresponding to an external terminal Dyn (also referred to as an upper wiring), whereas reference numeral 4 denotes a thin film including an electron-emitting region, reference numerals 5 and 6 denote a pair of device electrodes and reference numerals 141 and 142 respectively denotes an interlayer insulation layer and a contact hole for connecting a device electrode 5 and a lower wiring 82.

Now, the method of manufacturing the device specimens will be described below in terms of an experiment conducted for the apparatus, referring to FIGS. 15A through 15D and 16A through 16D.

Figure 15A:
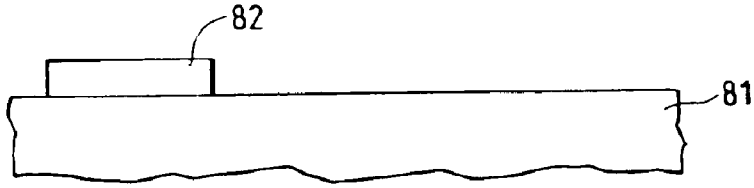
FIGS. 15A through 15D and 16A through 16D are schematic partial sectional side views of the substrate of FIG. 13, showing different steps of the method of manufacturing the same.

Step A:

After thoroughly cleansing a soda lime glass plate a silicon oxide film was formed thereon to a thickness of 0.5 micron by sputtering to produce a substrate 81, on which a photoresist (AZ1370: available from Hoechst Corporation) was formed by means of a spinner, while rotating the film, and baked. Thereafter, a photo-mask image was exposed to light and developed to produce a resist pattern for the lower wirings 82 and then the deposited Au/Cu film was wet-etched to produce lower wires 82 having a desired profile (FIG. 15A).

Figure 15B:
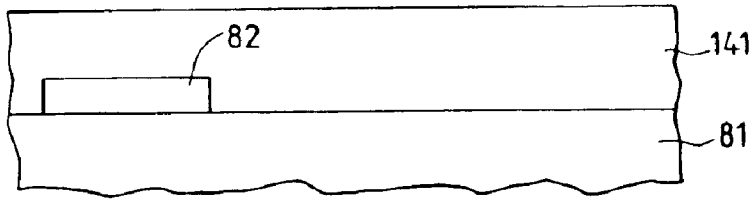

Step B:

A silicon oxide film was formed as an interlayer insulation layer 141 to a thickness of 1.0 micron by RF sputtering (FIG. 15B).

Figure 15C:
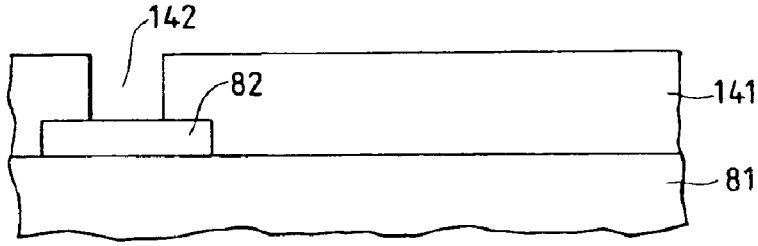

Step C:

A photoresist pattern was prepared for producing a contact hole 142 in the silicon oxide film deposited in Step B, which contact hole 142 was then actually formed by etching the interlayer insulation layer, using the photoresist pattern for a mask. RIE (Reactive Ion Etching) using $CF_4$ and $H_2$ gas was employed for the etching operation (FIG. 15C).

Figure 15D:
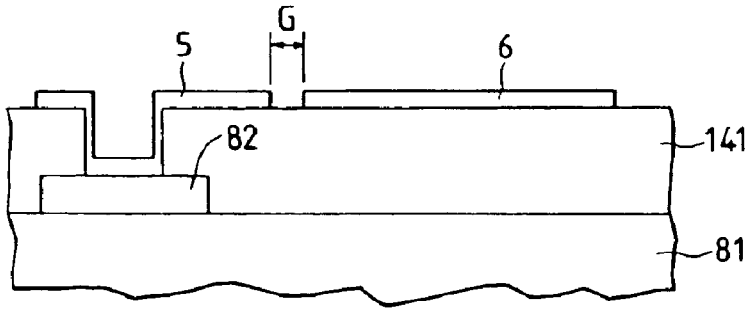

Step D:

Thereafter, a pattern of photoresist (RD-2000N: available from Hitachi Chemical Co., Ltd.) was formed for a pair of device electrodes 5 and 6 and a gap G separating the electrodes and then Ti and Ni were sequentially deposited thereon respectively to thicknesses of 50 Å and 1,000 Å by vacuum deposition. The photoresist pattern was dissolved by an organic solvent and the Ni/Ti deposit film was treated by using a lift-off technique to produce a pair of device electrodes 5 and 6 having a width W1 of 300 microns and separated from each other by a distance G of 3 microns (FIG. 15D).

Figure 16A:
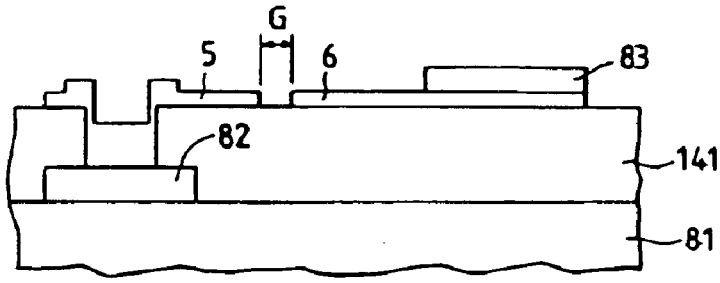

Step E:

After forming a photoresist pattern on the device electrodes 5, 6 for upper wirings 83, Ti and Au were sequentially deposited by vacuum deposition to respective thicknesses of 5 nm and 500 nm and then unnecessary areas were removed by means of the lift-off technique to produce upper wirings 83 having a desired profile (FIG. 16A).

Figure 16B:
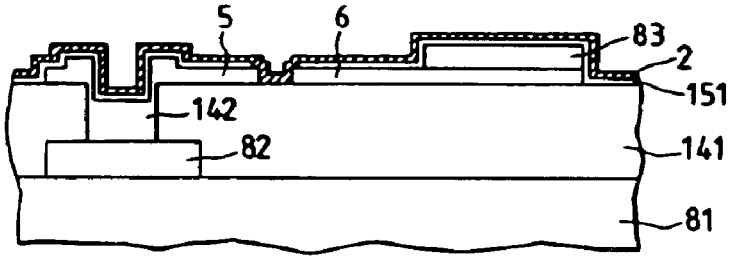

Step F:

A mask of the thin film 2 was prepared for forming the electron-emitting region of the device. The mask had an opening for the gap L1 separating the device electrodes and its vicinity. The mask was used to form a Cr film 151 to a film thickness of 1,000 Å by vacuum deposition, which was then subjected to a patterning operation. Thereafter, organic Pd (ccp4230: available from Okuno Pharmaceutical Co., Ltd.) was applied to the Cr film by means of a spinner, while rotating the film, and baked at 300° C. for 10 minutes to produce a thin film 2 for forming an electron-emitting region, which was made of fine particles containing Pd as a principal ingredient and had a film thickness of 8.5 nm and an electric resistance per unit area of $3.9\times10^4$ Ω/□. Note that the term "a fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is that of recognizable fine particles arranged in any of the above described states (FIG. 16B).

Figure 16C:
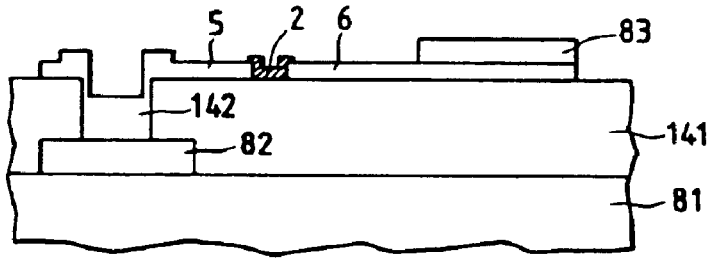

Step G:

The Cr film 151 and the baked thin film 2 for forming an electron-emitting region were etched by using an acidic etchant to produce a desired pattern (FIG. 16C).

Step H:

Then, a pattern for applying photoresist to the entire surface area except the contact hole 142 was prepared and Ti and Au were sequentially deposited by vacuum deposition to respective thicknesses of 5 nm and 500 mm. Any unnecessary areas were removed by means of the lift-off technique to consequently bury the contact hole 142.

Figure 16D:
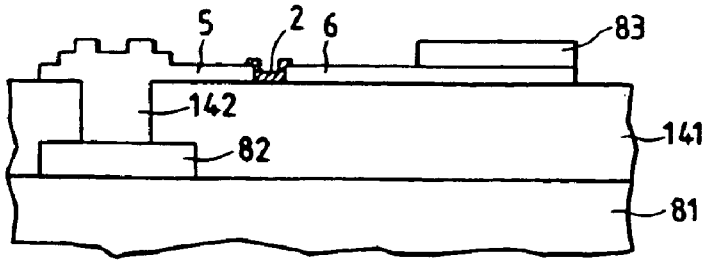

Now, lower wirings 82, an interlayer insulation layer 141, upper wirings 83, a pair of device electrodes 5 and 6 and a thin film 2 for forming an electron-emitting region were produced on the substrate 81 (FIG. 16D).

In an experiment, an image-forming apparatus was produced by using an electron source prepared in the above experiment. This apparatus will be described by referring to FIGS. 8 and 9.

A substrate 81 carrying thereon a large number of surface conduction electron-emitting devices prepared according to the above described process was rigidly fitted to a rear plate 91 and thereafter a face plate (prepared by forming a fluorescent film 94 and a metal back 95 on a glass substrate 93) was arranged 5 mm above the substrate 81 by interposing a support frame 92 therebetween. Frit glass was applied to junction areas of the face plate 96, the support frame 92 and the rear plate 91, which were then baked at 400° C. for 10 minutes in the atmosphere and bonded together. The substrate 81 was also firmly bonded to the rear plate 91 by means of frit glass (FIG. 9).

In FIG. 9, reference numeral denotes electron-emitting devices and numerals 82 and 83 respectively denotes X-directional wirings and Y-directional wirings.

While the fluorescent film 94 may be solely made of fluorescent bodies if the image-forming apparatus is for black and white pictures, firstly black stripes were arranged and then the gaps separating the black stripes were filled with respective fluorescent bodies for primary colors to produce a fluorescent film 94 in this experiment. The black stripes were made of a popular material containing graphite as a principal ingredient. The fluorescent bodies were applied to the glass substrate 93 by using a slurry method.

A metal back 95 is normally arranged on the inner surface of the fluorescent film 94. In this experiment, a metal back was prepared by producing an Al film by vacuum deposition on the inner surface of the fluorescent film 94 that had been smoothed in a so-called filming process.

The face plate 96 may be additionally provided with transparent electrodes (not shown) arranged close to the outer surface of the fluorescent film 94 in order to improve the conductivity of the fluorescent film 94, no such electrodes were used in the experiment because the metal back proved to be sufficiently conductive.

The fluorescent bodies were carefully aligned with the respective electron-emitting devices before the above described bonding operation.

The prepared glass container was then evacuated by means of an exhaust pipe (not shown) and an exhaust pump to achieve a sufficient degree of vacuum inside the container. Thereafter, the thin films 2 of the electron-emitting devices 84 were subjected to an electric forming operation, where a voltage was applied to the device electrodes 5, 6 of the electron-emitting devices 84 by way of the external terminals Dox1 through Doxm and Doy1 through Doyn to produce an electron-emitting region 3 in each device. The voltage used in the forming operation had a waveform same as the one shown in FIG. 4B.

Referring to FIG. 4B, T1 and T2 were respectively 1 milliseconds and 10 milliseconds and the electric forming operation was carried out in vacuum of a degree of approximately $1\times10^{-5}$ torr.

Dispersed fine particles containing palladium as a principal ingredient were observed in the electron-emitting region 3 of each device that had been produced in the above process. The fine particles had an average particle size of 30 angstroms.

Thereafter, the devices were subjected to a high resistance activation process, where a voltage having a rectangular waveform the same as that of the voltage used in the forming operation and a wave height of 14 V was applied to each device, observing the device current If and the emission current Ie.

Finished electron-emitting devices 84 having an electron-emitting region 3 were produced after the forming and activation processes.

Subsequently, the enclosure was evacuated by means of an oil-free ultra-high vacuum device to a degree of vacuum of approximately $10^{-6}$ torr and then hermetically sealed by melting and closing the exhaust pipe (not shown) by means of a gas burner.

Finally, the apparatus was subjected to a getter process using a high frequency heating technique in order to maintain the degree of vacuum in the apparatus after the sealing operation.

The electron-emitting devices of the above image-forming apparatus were then caused to emit electrons by applying a scan signal and a modulation signal from a signal generating means (not shown) through the external terminals Dx1 through Dxm and Dy1 through Dyn and the emitted electrons were accelerated by applying a high voltage of 5 kV to the metal back 95 or the transparent electrodes (not shown) via the high voltage terminal Hv so that they collided with the fluorescent film 94 until the latter was energized to emit light and produce an image. Both the device current If and the emission current Ie of each device were similar to those illustrated in FIG. 7 by solid lines to prove the device operated stably from the initial stages. The emission current Ie was such that it could sufficiently meet the requirement of brightness of 100 fL to 150 fL of a television set.

Example 3

Specimens of electron-emitting device were prepared as in the case of Example 1.

Each of the prepared electron-emitting devices had a device width W2 of 300 $\mu$m and the thin film 2 for an electron-emitting region of the device had a film thickness of 10 nm and an electric resistance per unit area of $5\times10^{4}$ Ω/□. Otherwise, the devices were the same as their counterparts of Example 1.

Then, a gauging system as illustrated in FIG. 3 was set in position and the inside was evacuated by means of a magnetic levitation pump to a degree of vacuum of $2\times10^{-8}$ torr. Subsequently, a voltage was applied to the device electrodes 5, 6 for electrically energizing the device (electric forming process) by the power source 31 provided there for applying a device voltage Vf to the device. FIG. 4B shows the waveform of the voltage used for the electric forming process.

In FIG. 4B, T1 and T2 respectively denote the pulse width and the pulse interval of the applied pulse voltage, which were respectively 1 millisecond and 10 milliseconds for the experiment. The wave height (the peak voltage for the forming operation) of the applied pulse voltage was increased stepwise with a step of 0.1 V. During the forming operation, a resistance measuring pulse voltage of 0.1 V was inserted during each T2 to determine the current resistance of the device. The forming operation and the application of the voltage to the device were terminated when the gauge for the resistance measuring pulse voltages showed a reading of resistance of approximately 1 M ohms. In the experiment, the reading of the gauge for the forming voltage Vform was 5.1 V.

Figure 4C:
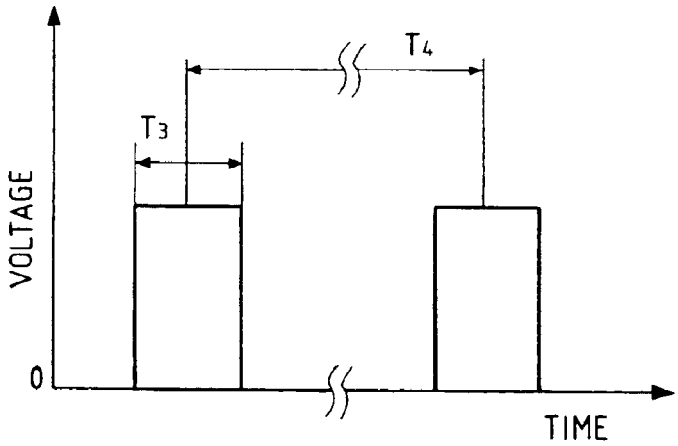

A prepared sample device was then subjected to an activation process in an atmosphere containing acetone (having a vapor pressure of 233 hPa at 20° C.) to a pressure of approximately $1\times10^{-5}$ torr for 20 minutes. FIG. 4C shows the waveform of the voltage applied to the device in the activation process.

In FIG. 4C, T3 and T4 respectively denote the pulse width and the pulse interval of the voltage wave, which were 10 microseconds and 10 milliseconds in the experiment. The wave height of the rectangular wave was 14 V.

Thereafter, the vacuum chamber of the gauging system was evacuated further to approximately $1\times10^{-8}$ torr.

Figure 12:
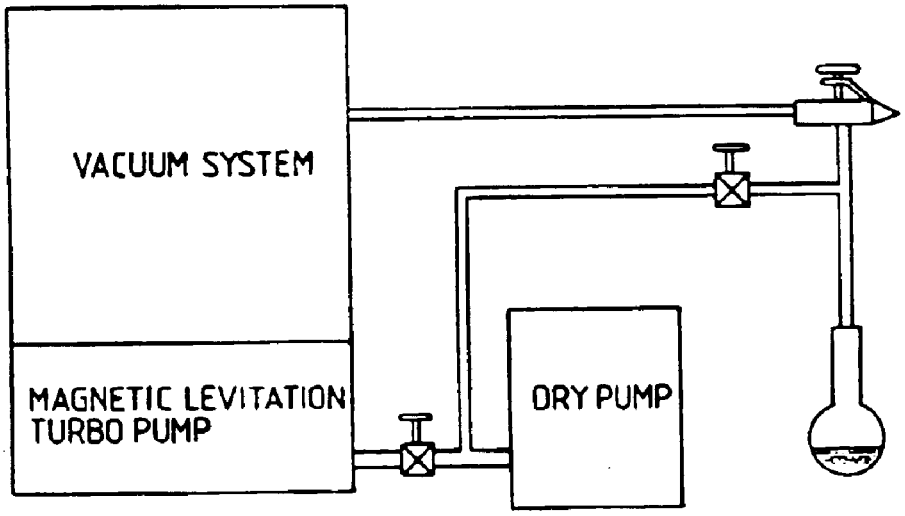
FIG. 12 is a block diagram of the system used for the activation process of Example 3 as described hereinafter.

During the experiment, organic substances to be used for the activation process were introduced via a feeding system (FIG. 12) comprising a needle valve and the inside pressure of the vacuum chamber was maintained to a substantially constant level.

Then, the performance of the device was determined by applying a voltage of 1 kV to the anode in the gauging system, where the device was separated from the anode by a distance H of 4 mm and the inside of the vacuum chamber was maintained to $1\times10^{-8}$ torr.

It was observed that, when the device voltage was 14 V, the device current and the mission current were respectively 2 mA and 1 $\mu$A to prove an electron emission efficiency θ of 0.05%. Table 1 shows the pulse width dependency of the device when the voltage was 14 V, the pulse interval was 16.6 msec. and the pulse width was 30 $\mu$sec., 100 $\mu$sec. and 300 $\mu$sec.

Example 4

Device specimens were prepared under conditions the same as those of Example 3 except that n-dodecane (having a vapor pressure of 0.1 hPa at 20° C.) was used in place of acetone for the activation process.

When one of the prepared devices was tested to see its If and Ie as in the case of Example 3 above, the device current and the emission current were respectively 2.2 mA and 1 $\mu$A for a device voltage of 14 V to prove an electron emission efficiency A of 0.045%. Table 1 shows the pulse width dependency of the device when tested under the conditions the same as those of Example 3.

Example 5

Device specimens were prepared under conditions the same as those of Example 3 except that the activation process was carried out for two hours by using formaldehyde (having a vapor pressure of 4,370 hPa at 20° C.) in place of acetone.

When one of the prepared devices was tested to see its If and Ie as in the case of Example 3 above, the device current and the emission current were respectively 1 mA and 0.2 $\mu$A for a device voltage of 14 V to prove an electron emission efficiency θ of 0.02%.

Example 6

Device specimens were prepared under conditions the same as those of Example 3 except that n-hexane (having a vapor pressure of 160 hPa at 20° C.) was used in place of acetone for the activation process.

When one of the prepared devices was tested to see its If and Ie as in the case of Example 3 above, the device current and the emission current were respectively 1.8 mA and 0.8 $\mu$A for a device voltage of 14 V to prove an electron emission efficiency θ of 0.044%. Table 1 shows the pulse width dependency of the device when tested under the conditions the same as those of Example 3.

Example 7-a

Device specimens were prepared under conditions the same as those of Example 3 except that n-undecane (having a vapor pressure of 0.35 hPa at 20° C.) was used in place of acetone for the activation process.

When one of the prepared devices was tested to see its If and Ie as in the case of Example 3 above, the device current and the emission current were respectively 1.5 mA and 0.6 $\mu$A for a device voltage of 14 V to prove an electron emission efficiency θ of 0.04%. Table 1 shows the pulse width dependency of the device when tested under the conditions the same as those of Example 3.

Example 7-b

Device specimens were prepared under conditions the same as those of Example 1 except organic substances were not introduced into the gauging system and the activation process was carried out in a vacuum/exhaust system having an oily atmosphere (connected directly to a rotary pump and a turbo pump and capable of producing a degree of vacuum of $5\times10^{-7}$ torr).

When one of the prepared devices was tested to see its If and Ie as in the case of Example 1 above, the device current and the emission current were respectively 2.2 mA and 1.1 $\mu$A for a device voltage of 14 V to prove an electron emission efficiency θ of 0.045%. Table 1 shows the pulse width dependency of the device when tested under the conditions the same as those of Example 3.

Example 8

In this example, an image-forming apparatus comprising a large number of surface conduction electron-emitting devices arranged to a simple matrix arrangement was prepared as in the case of Example 2.

Firstly, a glass container containing an electron source like that of Example 2 was produced and the glass container was evacuated to a degree of vacuum of $1\times10^{4}$ torr via an exhaust pipe (not shown) by means of an oil-free vacuum pump.

Thereafter, the thin films 2 of the electron-emitting devices 84 were subjected to an electric forming operation, where a voltage was applied to the device electrodes 5, 6 of the electron-emitting devices 84 by way of the external terminals Dox1 through Doxm and Doy1 through Doyn to produce an electron-emitting region 3 in each device. The voltage used in the forming operation had a waveform the same as the one shown in FIG. 4B.

Dispersed fine particles containing palladium as a principal ingredient were observed in the electron-emitting region 3 of each device that had been produced in the above process. The fine particles had an average particle size of 30 angstroms.

Thereafter, the devices were subjected to an activation process, where acetone was introduced into the glass container to a pressure of $1\times10^{-3}$ torr and a voltage was applied to the device electrodes 5, 6 of each electron-emitting device 84 via appropriate ones of the external terminals Dox1 through Doxm and Doy1 through Doyn. FIG. 4C shows the waveform of the voltage used for the activation process.

Subsequently, the acetone contained in the container was evacuated to produce finished electron-emitting devices.

Then, the components of the apparatus were baked at 120° C. for 10 hours in vacuum of a degree of approximately $1\times10^{-6}$ torr and the enclosure was hermetically sealed by melting and closing the exhaust pipe (not shown) by means of a gas burner.

Finally, the apparatus was subjected to a getter process using a high frequency heating technique in order to maintain the degree of vacuum in the apparatus after the sealing operation. A getter containing Ba as a principal component had been arranged in a predetermined position (not shown) before hermetically sealing the enclosure to form a film inside the enclosure through vapor deposition.

The electron-emitting devices of the above image-forming apparatus were then caused to emit electrons by applying a scan signal and a modulation signal from a signal generating means (not shown) through the external terminals Dx1 through Dxm and Dyl through Dyn and the emitted electrons were accelerated by applying a high voltage of 7 kV to the metal back 95 or the transparent electrodes (not shown) via the high voltage terminal Hv so that they collide with the fluorescent film 94 until the latter was energized to emit light and produce an image.

Example 9

This example deals with an image-forming apparatus comprising a large number of surface conduction electron-emitting devices and control electrodes (grids).

Since an apparatus to be dealt with in this example can be prepared in a way as described above concerning the image-forming apparatus of Example 2, the method of manufacturing the same will not be described any further.

The configuration of the apparatus will be described in terms of the electron source of the apparatus prepared by arranging a number of surface conduction electron-emitting devices.

Figure 17:
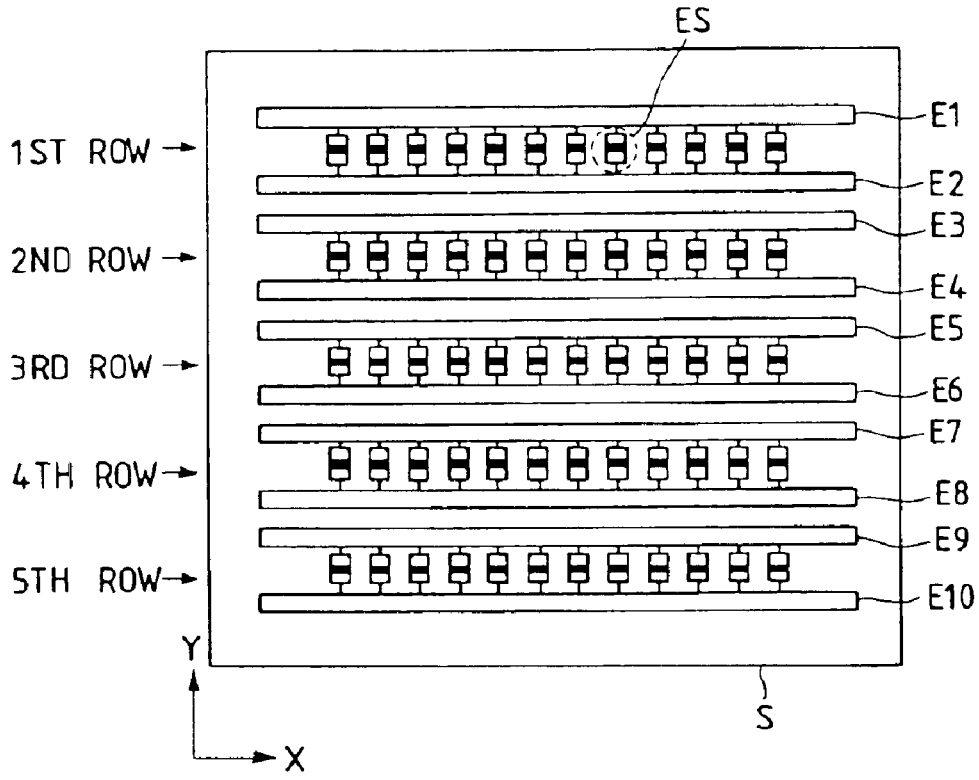
FIGS. 17 and 18 are schematic plan views of two different substrates of electron source alternatively used in the image-forming apparatus of Example 9.
Figure 18:
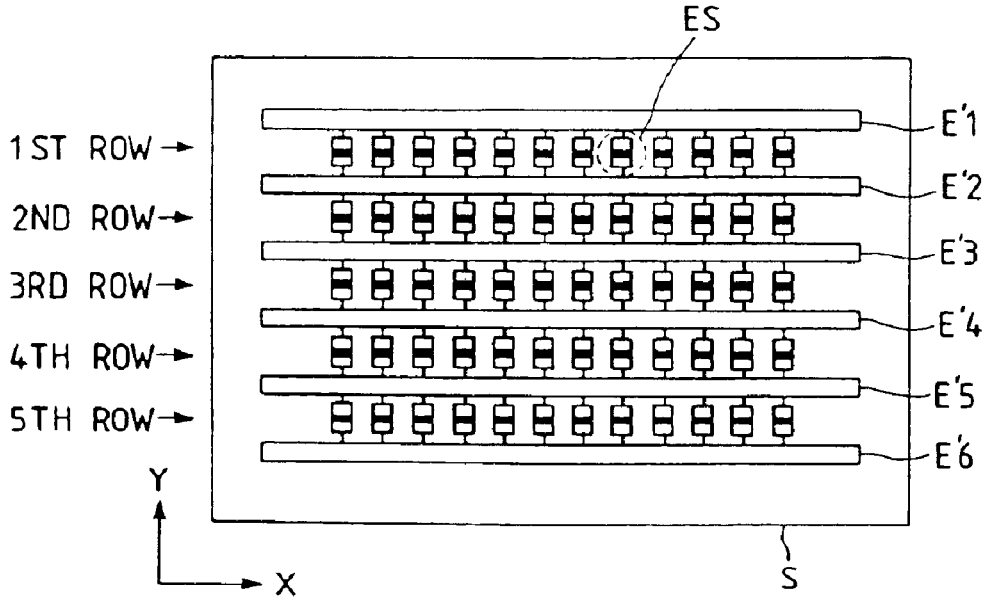

FIGS. 17 and 18 are schematic plan views of two different substrates of electron source alternatively used in the image-forming apparatus of Example 9.

Firstly referring to FIG. 17, S denotes an insulator substrate typically made of glass and ES denotes a surface conduction electron-emitting device arranged on the substrate S and shown in a dotted circle, whereas E1 through E10 denote wiring electrodes for wiring the surface conduction electron-emitting devices, which are arranged in columns on the substrate along the X-direction (hereinafter referred to as device columns). The surface conduction electron-emitting devices of each device column are electrically connected in parallel with each other by a pair of wiring electrodes. (For instance, the devices of the first device column are connected in parallel with each other by the wiring electrodes E1 and E10.)

In the apparatus of this example comprising the above described electron source, the electron source can drive any device column independently by applying an appropriate drive voltage to the related wiring electrodes. More specifically, a voltage exceeding the electron emission threshold level is applied to the device columns to be driven to emit electrons, whereas a voltage below the electron emission threshold level (e.g., 0 V) is applied to the remaining device columns. (A drive voltage exceeding the electron emission threshold level is referred to as VE [V] hereinafter.)

In FIG. 18, illustrating another electron source that can be used for this example, S denotes an insulator substrate typically made of glass and ES denotes an surface conduction electron-emitting device arranged on the substrate S and shown in a dotted circle, whereas E'1 through E'6 denote wiring electrodes for wiring the surface conduction electron-emitting devices, which are arranged in columns on the substrate along the X-direction. The surface conduction electron-emitting devices of each device column are electrically connected in parallel with each other by a pair of wiring electrodes. Additionally, in this alternative electron source, a single wiring electrode is arranged between any two adjacent device columns to serve for the both columns. For instance, a common wiring electrode E'2 serves for both the first device column and the second device column. This arrangement of wiring electrodes is advantageous in that, if compared with the arrangement of FIG. 17, the space separating any two adjacent columns of surface conduction electron-emitting devices can be significantly reduced.

In the apparatus of this example comprising the above described electron source, the electron source can drive any device column independently by applying an appropriate drive voltage to the related wiring electrodes. More specifically, VE[V] is applied to the device columns to be driven to emit electrons, whereas 0 V is applied to the remaining device columns. For instance, only the devices of the third column can be driven to operate by applying 0 V to the wiring electrodes E'1 through E'3 and VE[V] to the wiring electrodes E'4 through E'6. Consequently, VE−O=VE[V] is applied to the devices of the third column, whereas 0[V], 0−0=0[V] or VE−VE=O[V], is applied to all the devices of the remaining columns. Likewise, the devices of the second and the fifth columns can be driven to operate simultaneously by applying 0[V] to the wiring electrodes E'1, E'2 and E'6 and VE[V] to the wiring electrodes E'3, E'4 and E'5. In this way, the devices of any device column of this electron source can be driven selectively.

While each device column has twelve (12) surface conduction electron-emitting devices arranged along the X-direction in the electron sources of FIGS. 17 and 18, the number of devices to be arranged in a device column is not limited thereto and a greater number of devices may alternatively be arranged. Additionally, while there are five (5) device columns in each of the electron sources, the number of device columns is not limited thereto and a greater number of device columns may alternatively be arranged.

Now, a panel type CRT incorporating an electron source of the above described type will be described.

Figure 19:
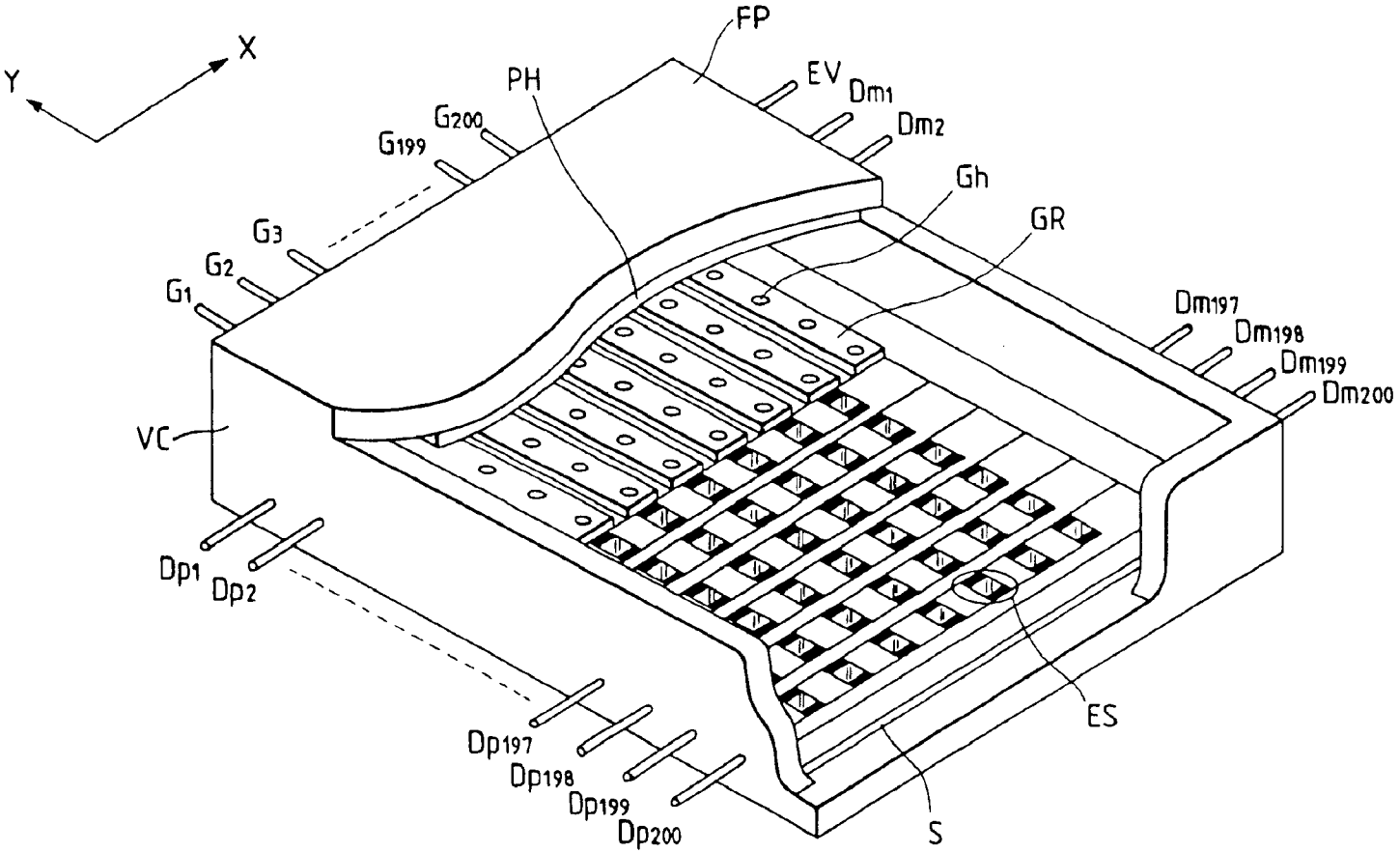
FIGS. 19 and 22 are schematic perspective views of two different panels alternatively used in the image-forming apparatus of Example 9.

FIG. 19 is a schematic perspective view of a panel type CRT incorporating an electron source as illustrated in FIG. 17. In FIG. 19, VC denotes a glass vacuum container provided with a face plate FP for displaying images. A transparent electrode is arranged on the inner surface of the face plate PH and red, green and blue fluorescent members are applied onto the transparent electrode in the form of a mosaic or stripes without interfering with each other. To simplify the illustration, the transparent electrodes and the fluorescent members are collectively indicated by PH in FIG. 19. A black matrix or black stripes known in the field of CRT may be arranged to fill the blank areas of the transparent electrode that are not occupied by the fluorescent matrix or stripes. Similarly, a metal back layer of any known type may be arranged on the fluorescent members. The transparent electrode is electrically connected to the outside of the vacuum container by way of a terminal EV so that an voltage may be applied thereto in order to accelerate electron beams.

In FIG. 19, S denotes the substrate of the electron source rigidly fitted to the bottom of the vacuum container VC, on which a number of surface conduction electron-emitting devices are arranged as described above by referring to FIG. 17. More specifically, a total of 200 device columns, each having 200 devices, are arranged on the substrate. Each device column is provided with a pair of wiring electrodes and the wiring electrodes of the apparatus are connected to the electrodes terminals Dp1 through Dp200 and Dm1 through Dm200 arranged on the respective opposite sides of the panel in an alternate manner so that electric drive signals may be applied to the devices from outside of the vacuum container.

In an experiment using a finished glass container VC (FIG. 19), the container was evacuated to a sufficient degree of vacuum via an exhaust pipe (not shown) by means of an vacuum pump and, thereafter, the electron-emitting devices ES were subjected to an electric forming operation, where a voltage was applied to the devices by way of the external terminals DP1 through DP200 and Dm1 through Dm200. The voltage used in the forming operation had a waveform same as the one shown in FIG. 4B. In the experiment, T1 and T2 were respectively 1 millisecond and 10 milliseconds and the electric forming operation was carried out in vacuum of a degree of approximately $1\times10^{-5}$ torr.

Thereafter, the devices were subjected to an activation process, where acetone was introduced into the glass container to a pressure of 1×110 torr and a voltage was applied to the electron-emitting devices ES via the external terminals Dp1 through Dp200 and Dm1 through Dm200. Then, the acetone contained in the container was evacuated to produce finished electron-emitting devices.

Dispersed fine particles containing palladium as a principal ingredient were observed in the electron-emitting region of each device that had been produced in the above process. The fine particles had an average particle size of 30 angstroms. Subsequently, the vacuum system used for the experiment was switched to an ultra-high vacuum system comprising an oil-free ion pump. Thereafter, the components of the apparatus were baked at 120° C. for a sufficient period of time in vacuum of a degree of approximately 1×10' torr.

Then, the enclosure was hermetically sealed by melting and closing the exhaust pipe (not shown) by means of a gas burner.

Finally, the apparatus was subjected to a getter process using a high frequency heating technique in order to maintain the degree of vacuum in the apparatus after the sealing operation and finish the operation of preparing the image-forming apparatus.

Stripe-shaped grid electrodes GR are arranged between the substrate S and the face plate. There are provided a total of 200 grid electrodes GR arranged in a direction perpendicular to that of the device columns (or in the Y-direction) and each grid electrode has a given number of openings Gh for allowing electron beams to pass therethrough. More specifically, while a circular opening Gh is typically provided for each surface conduction electron-emitting device, the openings may alternatively be realized in the form of a mesh. The grid electrodes are electrically connected to the outside of the vacuum container via respective electric terminals G1 through G200. Note that the grid electrodes may be differently arranged in terms of shape and location from those of FIG. 19 so long as they can successfully modulate electron beams emitted from the surface conduction electron-emitting devices. For instance, they may be arranged around or in the vicinity of the surface conduction electron-emitting devices.

The above described display panel comprises surface conduction electron-emitting devices arranged in 200 device columns and 200 grid electrodes to form an X-Y matrix of 200×200. With such an arrangement, an image can be displayed on the screen on a line by line basis by applying a modulation signal to the grid electrodes for a single line of an image in synchronism with the operation of driving (scanning) the surface conduction electron-emitting devices on a column by column basis to control the irradiation of electron beams onto the fluorescent film.

Figure 20:
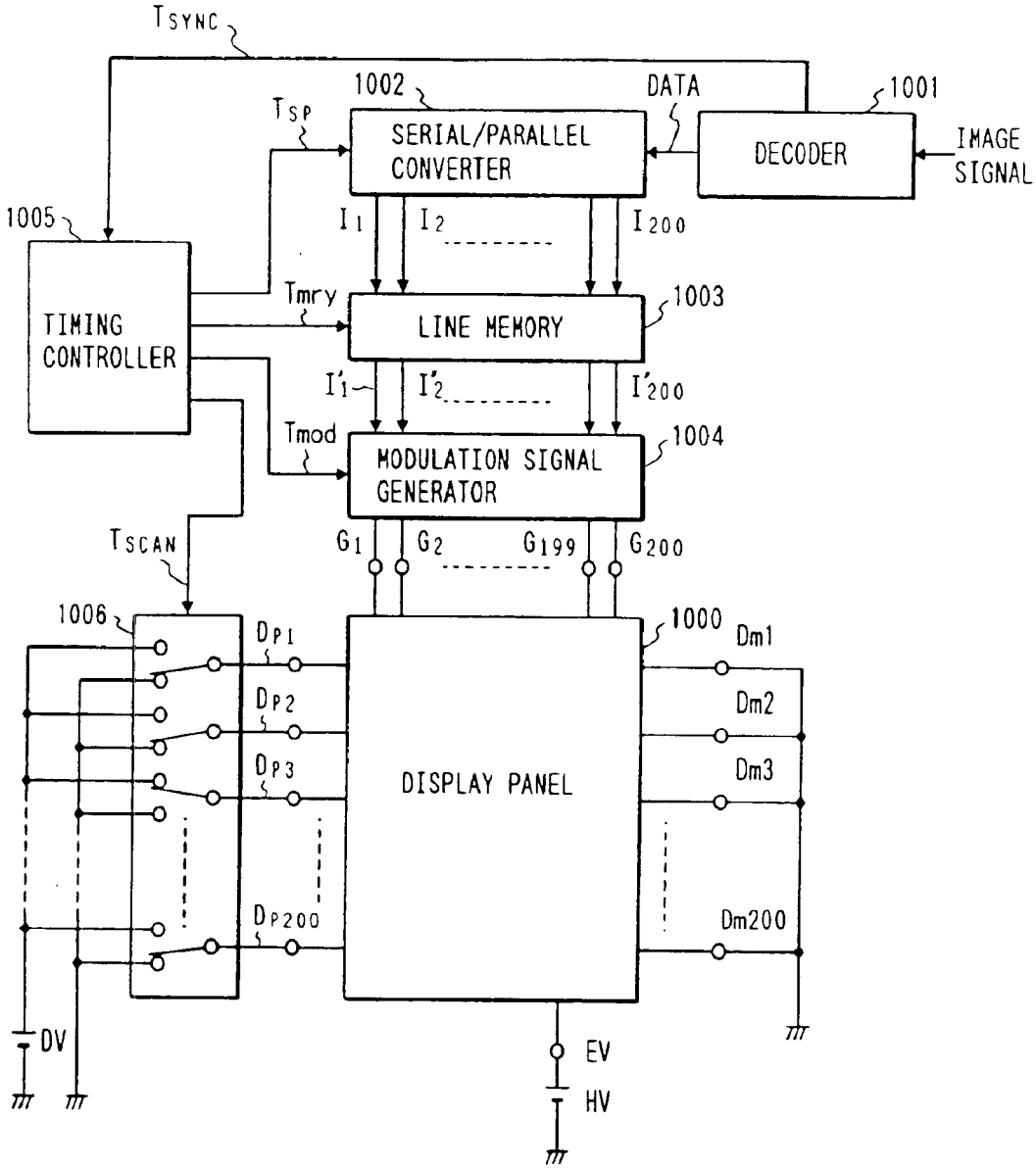
FIGS. 20 and 23 are block diagrams of two different electric circuits alternatively used to drive the image-forming apparatus of Example 9.

FIG. 20 is a block diagram of an electric circuit to be used for driving the display panel of FIG. 19. In FIG. 20, the circuit comprises the display panel 1000 of FIG. 19, a decode circuit 1001 for decoding composite image signals transmitted from outside, a serial/parallel conversion circuit 1002, a line memory 1003, a modulation signal generation circuit 1004, a timing control circuit 1005 and a scan signal generating circuit 1006. The electric terminals of the display panel 1000 are connected to the related circuits. Specifically, the terminal EV is connected to a voltage source HV for generating an acceleration voltage of 10[kV] and the terminals G1 through G200 are connected to the modulation signal generation circuit 1004 while the terminals Dp1 through Dp200 are connected to the scan signal generation circuit 1006 and the terminals Dm1 through Dm200 are grounded.

Now, how each component of the circuit operates will be described. The decode circuit 1001 is a circuit for decoding incoming composite image signals such as NTSC television signals and separating brightness signals and synchronizing signals from the received composite signals. The former are sent to the serial/parallel conversion circuit 1002 as data signals and the latter are forwarded to the timing control circuit 1005 as Tsync signals. In other words, the decode circuit 1100 rearranges the values of brightness of the primary colors of RGB corresponding to the arrangement of color pixels of the display panel 1000 and serially transmits them to the serial/parallel conversion circuit 1002. It also extracts vertical and horizontal synchronizing signals and transmits them to the timing control circuits 1005. The timing control circuit 1005 generates various timing control signals in order to coordinate the operational timings of different components by referring to said synchronizing signal Tsync. More specifically, it transmits Tsp signals to the serial/parallel conversion circuit 1002, Tmry signals to the line memory 1003, Tmod signals to the modulation signal generation circuit 1004 and Tscan signals to the scan signal generation circuit 1005.

The serial/parallel conversion circuit 1002 samples brightness signals Data it receives from the decode circuit 1001 on the basis of timing signals Tsp and transmits them as 200 parallel signals 11 through 1200 to the line memory 1003. When the serial/parallel conversion circuit 1002 completes an operation of serial/parallel conversion on a set of data for a single line of an image, the timing control circuit 1005 a write timing control signal Tmry to the line memory 1003. Upon receiving the signal Tmry, it stores the contents of the signals 11 through 11200 and transmits them to the modulation signal generation circuit 1004 as signals I'1 through I'200 and holds them until it receives the next timing control signal Tmry.

The modulation signal generation circuit 1004 generates modulation signals to be applied to the grid electrodes of the display panel 1000 on the basis of the data on the brightness of a single line of an image it receives from the line memory 1003. The generated modulation signals are simultaneously applied to the modulation signal terminals G1 through G200 in correspondence to a timing control signal Tmod generated by the timing control circuit 1005. While modulation signals typically operate in a voltage modulation mode where the voltage to be applied to a device is modulated according to the data on the brightness of an image, they may alternatively operate in a pulse width modulation mode where the length of the pulse voltage to be applied to a device is modulated according to the data on the brightness of an image.

The scan signal generation circuit 1006 generates voltage pulses for driving the device columns of the surface conduction electron-emitting devices of the display panel 1000. It operates to turn on and off the switching circuits it comprises according to timing control signals Tscan generated by the timing control circuit 1005 to apply either a drive voltage VE[V] generated by a constant voltage source DV and exceeding the threshold level for the surface conduction electron-emitting devices or the ground potential level (0[V]) to each of the terminals Dp1 through Dp200.

As a result of coordinated operations of the above described circuits, drive signals are applied to the display panel 1000 with the timings as illustrated in the graphs of FIGS. 21A through 21F. FIGS. 21A through 21D show part of signals to be applied to the terminals Dp1 through Dp200 of the display panel from the scan signal generation circuit 1006. It is seen that a voltage pulse having an amplitude of VE[V] is applied sequentially to Dp1, Dp2, Dp3, . . . within a period of time for display a single line of an image. On the other hand, since the terminals Dm1 through Dm200 are constantly grounded and held to 0[V], the device columns are sequentially driven by the voltage pulse to emit electron beams from the first column.

Figures 21A, 21B, 21C, 21D, 21E, 21F:
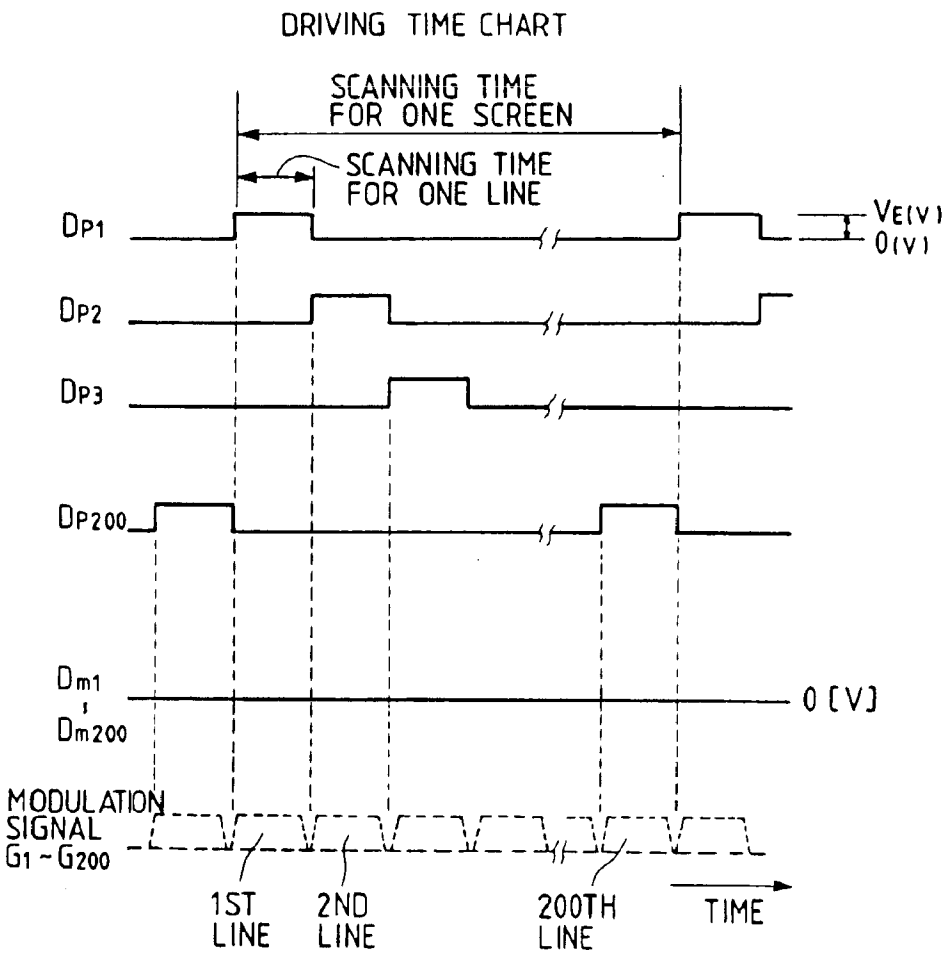
FIGS. 21A through 21F and 24A through 24I are two different sets of timing charts alternatively used to drive the image-forming apparatus of Example 9.

In synchronism with this operation, the modulation signal generation circuit 1004 applies moduation signals to the terminals G1 through G200 for each line of an image with the timing as shown by the dotted line in FIG. 21F. Modulation signals are sequentially selected in synchornism with the selection of scan signals until an entire image is displayed. By continuously repeating the above operation, moving images are displayed on the display screen for television.

A flat panel type CRT comprising an electron source of FIG. 17 has been described above. Now, a panel type CRT comprising an electron source of FIG. 18 will be described below by referring to FIG. 22.

Figure 22:
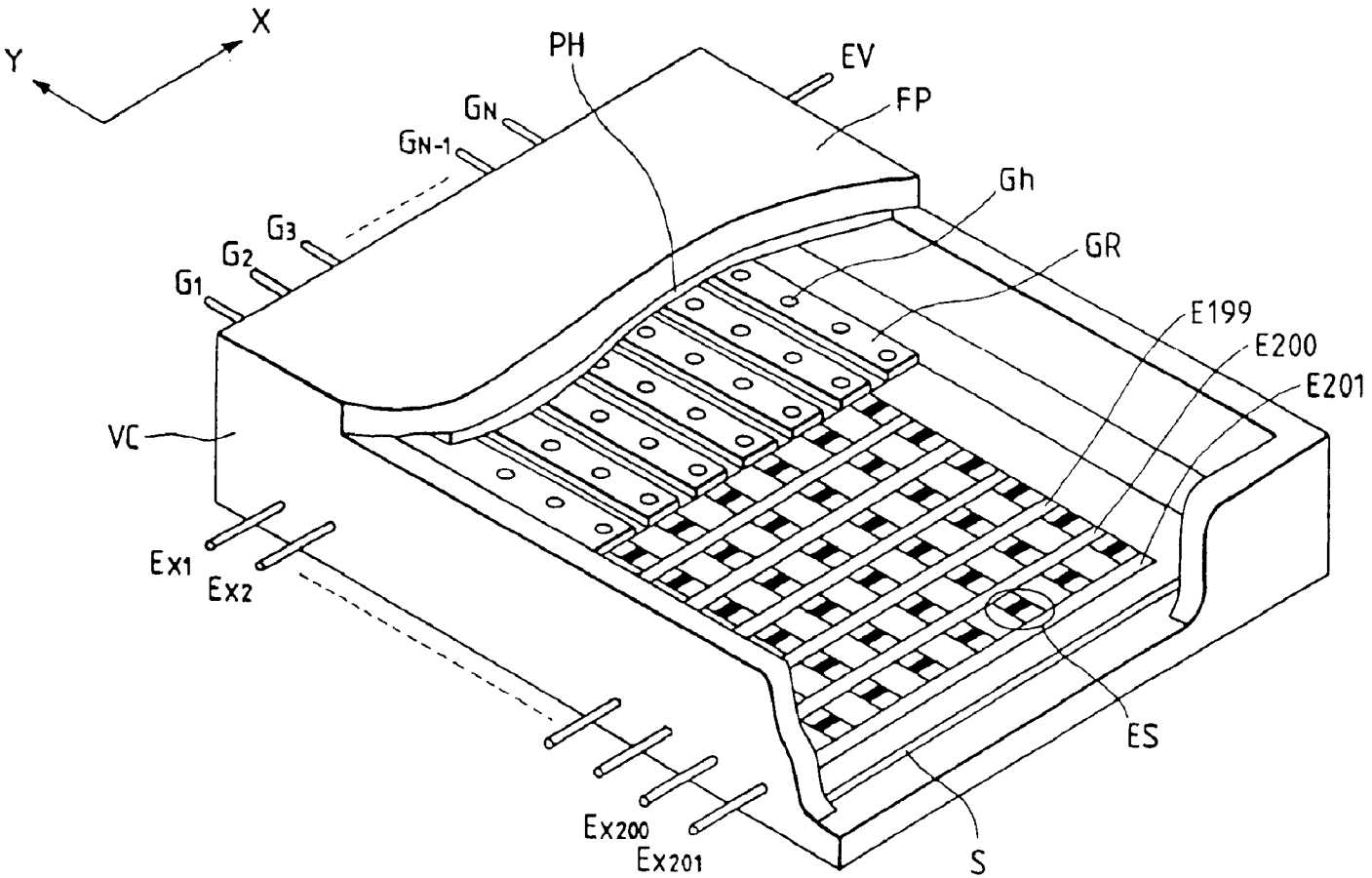

The panel type CRT of FIG. 22 is realized by replacing the electron source of the CRT of FIG. 19 with the one illustrated in FIG. 18, which comprises an X-Y matrix of 200 columns of electron-emitting devices and 200 grid electrodes. Note that the 200 columns of surface conduction electron-emitting devices are respectively connected to 201 wiring electrodes E1 through E201 and, therefore, the vacuum container is provided with a total of 201 electrode terminals Ex1 through Ex201.

In an experiment using a finished glass container VC (FIG. 22), the container was evacuated to a sufficient degree of vacuum via an exhaust pipe (not shown) by means of a vacuum pump and, thereafter, the electron-emitting devices ES were subjected to an electric forming operation, where a voltage was applied to the devices by way of the external terminals Ex1 through Ex201. The voltage used in the forming operation bad a waveform the same as the one shown in FIG. 4B. In the experiment, T1 and T2 were respectively 1 millisecond and 10 milliseconds and the electric forming operation was carried out in vacuum of a degree of approximately $1\times10^{-5}$ torr.

Thereafter, the devices were subjected to an activation process, where acetone was introduced into the glass container to a pressure of $1\times10^{-4}$ torr and a voltage was applied to the electron-emitting devices ES via the external terminals Dp1 through Dp200 and Dm1 through Dm200. Then, the acetone contained in the container was evacuated to produce finished electron-emitting devices.

Dispersed fine particles containing palladium as a principal ingredient were observed in the electron-emitting region of each device that had been produced in the above process. The fine particles had an average particle size of 30 angstroms. Subsequently, the vacuum system used for the experiment was switched to an ultra-high vacuum system comprising an oil-free ion pump. Thereafter, the components of the apparatus was baked at 120° C. for a sufficient period of time in vacuum of a degree of approximately $1\times10^{-6}$ torr.

Then, the enclosure was hermetically sealed by melting and closing the exhaust pipe (not shown) by means of a gas burner.

Finally, the apparatus was subjected to a getter process using a high frequency heating technique in order to maintain the degree of vacuum in the apparatus after the sealing operation and finish the operation of preparing the image-forming apparatus.

Figure 23:
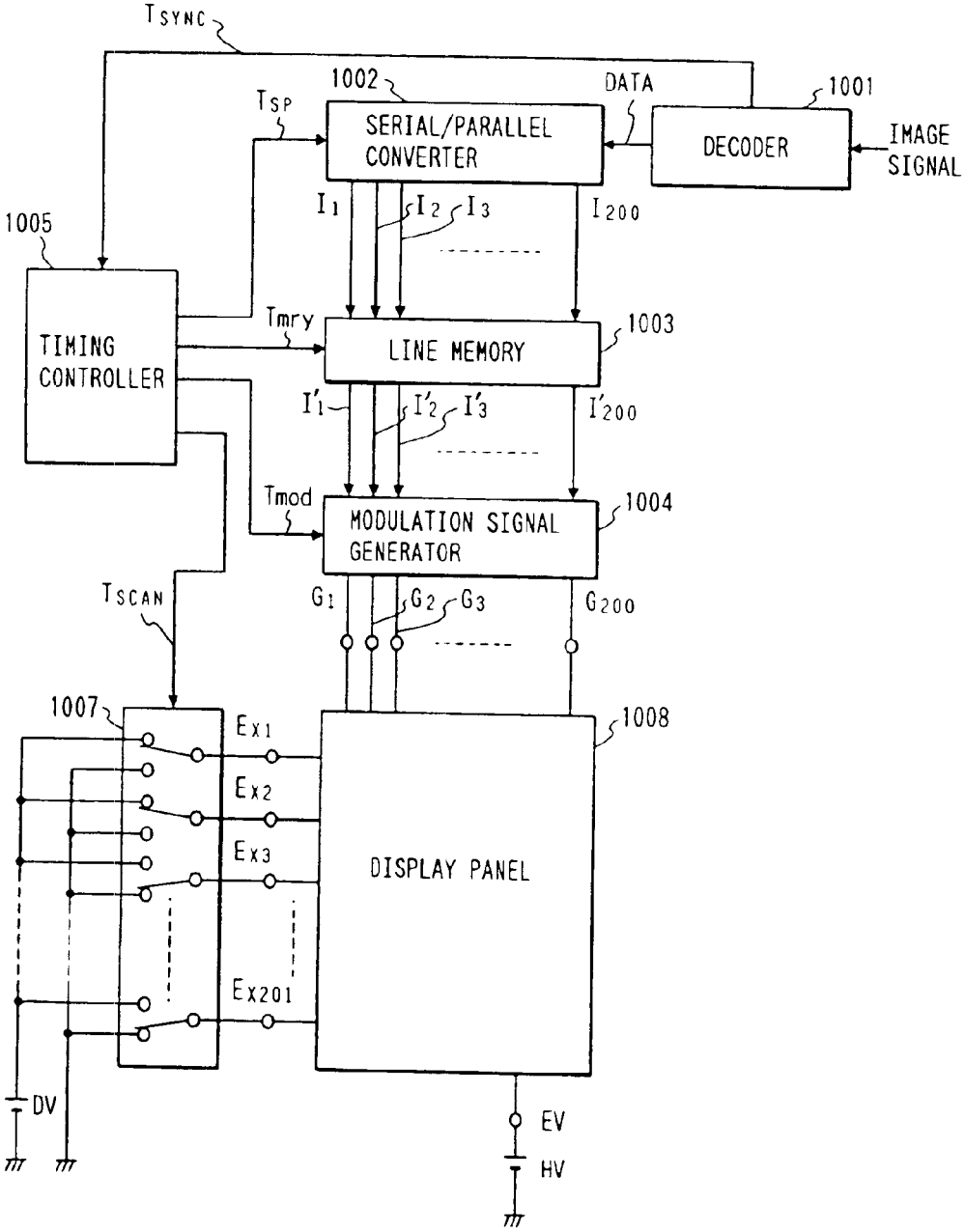
Figures 24A, 24B, 24C, 24D, 24E, 24F, 24G, 24H, 24I:
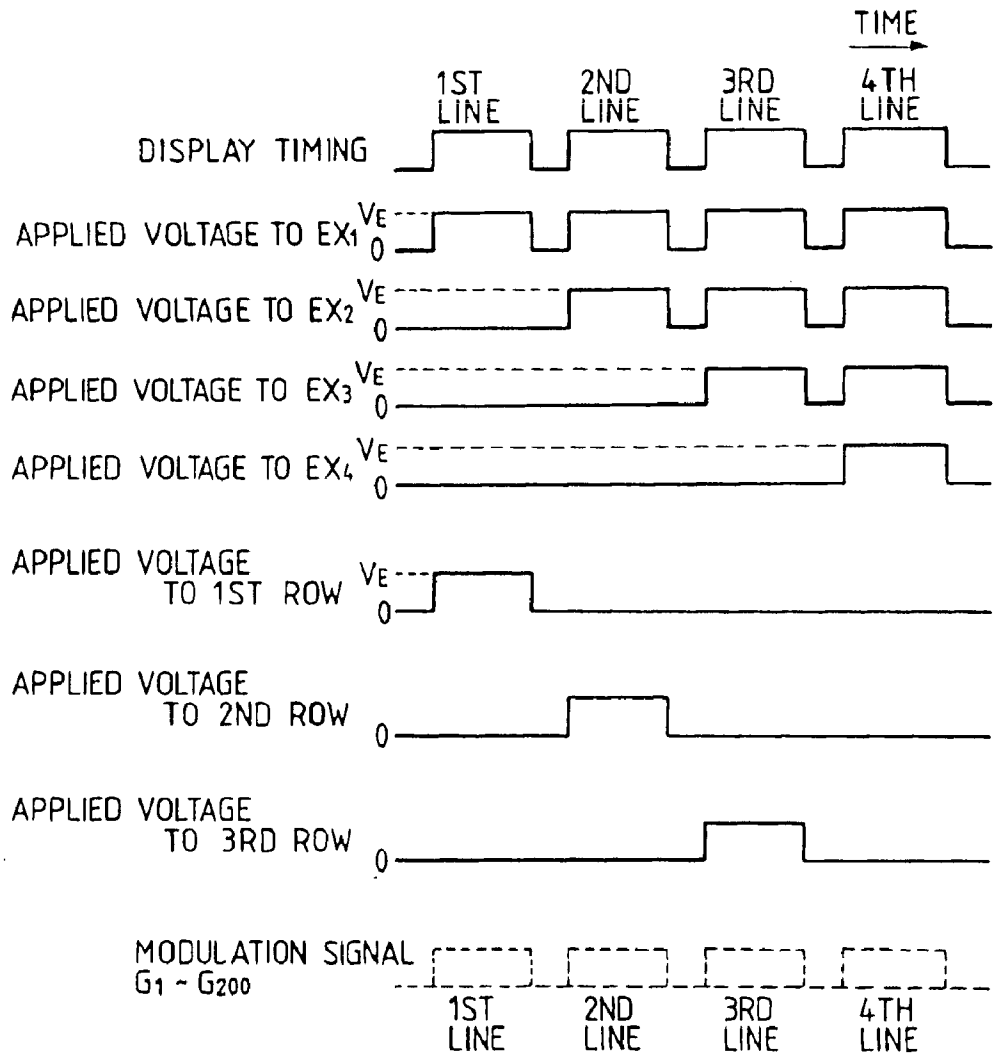

FIG. 23 shows a block diagram of a drive circuit for driving the display panel 1008. This circuit has a configuration basically the same as that of FIG. 20 except the scan signal generation circuit 1007. The scan signal generation circuit 1007 applies either a drive voltage VE[V] generated by a constant voltage source DV and exceeding the threshold level for the surface conduction electron-emitting devices or the ground potential level (0[V]) to each of the terminals of the display panel. FIGS. 24A through 24I show the timings with which certain signals are applied to the display panel. The display panel operates to display an image with the timing as illustrated in FIG. 24A as drive signals shown in FIGS. 24B through 24E are applied to the electrode terminals Ex1 through Ex4 from the scan signal generation circuit 1007 and, consequently, voltages as shown in FIGS. 24F through 24H are sequentially applied to the corresponding columns of surface conduction electron-emitting devices to drive the latter. In synchronism with this operation, modulation signals are generated by the modulation signal generation circuit 1004 with the timing as shown in FIG. 24I to display images on the display screen.

An image-forming apparatus of the type realized in this example operates very stably, showing full color images with excellent gradation and contrast.

Example 10

FIG. 25 is a block diagram of the display apparatus comprising an electron source realized by arranging a number of surface conduction electron-emitting devices and a display panel and designed to display a variety of visual data as well as pictures of television transmission in accordance with input signals coming from different signal sources. Referring to FIG. 25, the apparatus comprises a display panel 25100, a display panel drive circuit 25101, a display controller 25102, a multiplexer 25103, a decoder 25104, an input/output interface circuit 25105, a CPU 25106, an image generation circuit 25107, image memory interface circuits 25108, 25109 and 25110, an image input interface circuit 25111, TV signal receiving circuits 25112 and 25113 and an input section 25114. (If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.)

Now, the components of the apparatus will be described, following the flow of image data therethrough.

Firstly, the TV signal reception circuit 25113 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels. The TV signals received by the TV signal reception circuit 25113 are fowarded to the decoder 25104.

Secondly, the TV signal reception circuit 25112 is a circuit for receiving TV image signals transmitted via a wired transmission system using coaxial cables and/or optical fibers. Like the TV signal reception circuit 25113, the TV signal system to be used is not limited to a particular one and the TV signals received by the circuit are forwarded to the decoder 25104.

The image input interface circuit 25111 is a circuit for receiving image signals forwarded from an image input device such as a TV camera or an image pick-up scanner. It also forwards the received image signals to the decoder 25104.

The image memory interface circuit 25110 is a circuit for retrieving image signals stored in a video tape recorder (hereinafter referred to as VTR) and the retrieved image signals are also forwarded to the decoder 25104.

The image memory interface circuit 25109 is a circuit for retrieving image signals stored in a video disc and the retrieved image signals are also forwarded to the decoder 25104.

The image memory interface circuit 25108 is a circuit for retrieving image signals stored in a device for storing still image data such as so-called still disc and the retrieved image signals are also forwarded to the decoder 25104.

The input/output interface circuit 25105 is a circuit for connecting the display apparatus and an external output signal source such as a computer, a computer network or a printer. It carries out input/output operations for image data and data on characters and graphics and, if appropriate, for control signals and numerical data between the CPU 25106 of the display apparatus and an external output signal source.

The image generation circuit 25107 is a circuit for generating image data to be displayed on the display screen on the basis of the image data and the data on characters and graphics input from an external output signal source via the input/output interface circuit 25105 or those coming from the CPU 25106. The circuit comprises reloadable memories for storing image data and data on characters and graphics, read-only memories for storing image patterns corresponding given character codes, a processor for processing image data and other circuit components necessary for the generation of screen images.

Image data generated by the circuit for display are sent to the decoder 25104 and, if appropriate, they may also be sent to an external circuit such as a computer network or a printer via the input/output interface circuit 25105.

The CPU 25106 controls the display apparatus and carries out the operation of generating, selecting and editing images to be displayed on the display screen.

For example, the CPU 25106 sends control signals to the multiplexer 25103 and appropriately selects or combines signals for images to be displayed on the display screen. At the same time it generates control signals for the display panel controller 25102 and controls the operation of the display apparatus in terms of image display frequency, scanning method (e.g., interlaced scanning or non-interlaced scanning), the number of scanning lines per frame and so on.

The CPU 25106 also sends out image data and data on characters and graphic directly to the image generation circuit 25107 and accesses external computers and memories via the input/output interface circuit 25105 to obtain external image data and data on characters and graphics. The CPU 25106 may additionally be so designed as to particpate other operations of the display apparatus including the operation of generating and processing data like the CPU of a personal computer or a word processor. The CPU 25106 may also be connected to an external computer network via the input/output interface circuit 25105 to carry out computations and other operations, cooperating therewith.

The input section 25114 is used for forwarding the instructions, programs and data given to it by the operator to the CPU 25106. As a matter of fact, it may be selected from a variety of input devices such as keyboards, mice, joy sticks, bar code readers and voice recognition devices as well as any combinations thereof.

The decoder 25104 is a circuit for converting various image signals input via said circuits 25107 through 25113 back into signals for three primary colors, luminance signals and I and Q signals. Preferably, the decoder 25104 comprises image memories as indicated by a dotted line in FIG. 25 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 25104 in cooperation with the image generation circuit 25107 and the CPU 25106.

The multiplexer 25103 is used to appropriately select images to be displayed on the display screen according to control signals given by the CPU 25106. In other words, the multiplexer 25103 selects certain converted image signals coming from the decoder 25104 and sends them to the drive circuit 25101. It can also divide the display screen in a plurality of frames to display different images simultaneously by switching from a set of image signals to a different set of image signals within the time period for displaying a single frame.

The display panel controller 25102 is a circuit for controlling the operation of the drive circuit 25101 according to control signals transmitted from the CPU 25106.

Among others, it operates to transmit signals to the drive circuit 25101 for controlling the sequence of operations of the power source (not shown) for driving the display panel in order to define the basic operation of the display panel. It also transmits signals to the drive circuit 25101 for controlling the image display frequency and the scanning method (e.g., interlaced scanning or non-interlaced scanning) in order to define the mode of driving the display panel.

If appropriate, it also transmits signals to the drive circuit 25101 for controlling the quality of the images to be displayed on the display screen in terms of luminance, contrast, color tone and sharpness.

The drive circuit 25101 is a circuit for generating drive signals to be applied to the display panel 25100. It operates according to image signals coming from said multiplexer 25103 and control signals coming from the display panel controller 25102.

A display apparatus according to the invention and having a configuration as described above and illustrated in FIG. 25 can display on the display panel 25100 various images given from a variety of image data sources. More specifically, image signals such as television image signals are converted back by the decoder 25104 and then selected by the multiplexer 25103 before sent to the drive circuit 25101. On the other hand, the display controller 25102 generates control signals for controlling the operation of the drive circuit

25101 according to the image signals for the images to be displayed on the display panel 25100. The drive circuit 25101 then applies drive signals to the display panel 25100 according to the image signals and the control signals. Thus, images are displayed on the display panel 25100. All the above described operations are controlled by the CPU 25106 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 25104, the image generation circuit 25107 and the CPU 25106 participate such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 25 shows only an example of possible configuration of a display apparatus comprising a display panel provided with an electron source prepared by arranging a number of surface conduction electron-emitting devices and the present invention is not limited thereto. For example, some of the circuit components of FIG. 25 may be omitted or additional components may be arranged there depending on the application. For instance, if a display apparatus according to the invention is used for visual telephone, it may be appropriately made to comprise additional components such as a television camera, a microphone, lighting equipment and transmission/reception circuits including a modem.

Since a display apparatus according to the invention comprises a display panel that is provided with an electron source prepared by arranging a large number of surface conduction electron-emitting device and hence adaptable to reduction in the depth, the overall apparatus can be made very thin. Additionally, since a display panel comprising an electron source prepared by arranging a large number of surface conduction electron-emitting devices is adapted to have a large display screen with an enhanced luminance and provide a wide angle for viewing, it can offer really impressive scenes to the viewers with a sense of presence.

[Advantages of the Invention]

As described above, the present invention provides a method of manufacturing a surface conduction electron-emitting device comprising a pair of oppositely disposed device electrodes and a thin film including an electron-emitting region arranged on a substrate, wherein it comprises at least steps of forming a pair of electrodes, forming a thin film (including an electron-emitting region), conducting an electric forming process and conducting an activation process so that the electron emission performance of the device that has hitherto been undeterminable can be strictly controlled as the forming process and the activation process are conducted in two separate steps and a coat containing carbon in the form of graphite, amorphous carbon or a mixture thereof as a principal ingredient is formed on and around the electron-emitting region under a controlled manner.

Preferably, the activation process comprises steps of forming a coat containing carbon as a principal ingredient on the thin film and applying a voltage exceeding the voltage-controlled-negative-resistance level to the pair of electrodes of the device so that the coat containing carbon as a principal ingredient may be formed on the high voltage side from part of the electron-emitting region. With such an arrangement, the produced electron-emitting device can operate stably from the initial stages of operation with a low device current and a high efficiency.

According to the invention, there is also provided an electron source designed to emit electrons in accordance to input signals and comprising a plurality of electron-emitting devices of the above described type on a substrate, wherein the electron-emitting devices are arranged in rows, each device being connected to wirings at opposite ends, and a modulation means is provided for them or, alternatively, the pairs of device electrodes of the electron-emitting devices are respectively connected to m insulated X-directional wirings and n insulated Y-directional wirings, the electron-emitting devices being arranged in rows having a plurality of devices. With such an arrangement, an electron source according to the invention can be manufactured at low cost with a high yield. Additionally, an electron source according to the invention operates highly efficiently in an energy saving manner so that it alleviates the load imposed on the circuits that are peripheral to it.

According to the invention, there is also provided an image-forming apparatus for forming images according to input signals, said apparatus comprising at least image-forming members and an electron source according to the invention. Such an apparatus can ensure efficient and stable emission of electrons to be carried out in a controlled manner. If, for example, the image-forming members are fluorescent members, the image-forming apparatus may make a flat color television set that can display high quality images with a low energy consumption level.

TABLE 1

| | Device current (mA) | | | Emission current (μA) | | |
|---|---|---|---|---|---|---|
| Pulse width | 30 μs | 100 μs | 300 μs | 30 μs | 100 μs | 300 μs |
| Example 3 acetone | 1.8 | 2.0 | 2.0 | 0.9 | 0.9 | 1.0 |
| Example 6 n-hexane | 1.7 | 1.7 | 1.8 | 0.7 | 0.7 | 0.8 |
| Example 7-a n-undecane | 1.4 | 1.4 | 1.5 | 0.5 | 0.6 | 0.6 |
| Example 4 n-dodecane | 2.6 | 2.4 | 2.2 | 1.4 | 1.2 | 1.0 |
| Example 7-b oil | 2.9 | 2.5 | 2.2 | 1.7 | 1.4 | 1.1 |

What is claimed is:

1. A method of manufacturing an electron-emitting device, comprising a step of forming on a substrate, an electroconductive film having a fissure, and a step of forming on the electroconductive film and within the fissure, a deposit containing carbon as a principal constituent by connecting the deposit to the electroconductive film, wherein the deposit is formed so that a gap narrower than the fissure is formed within the fissure.

2. A method of manufacturing an electron-emitting device, comprising a step of forming on a substrate, an electroconductive film composed of an electroconductive material and having a fissure, and a step of forming on the electroconductive film and within the fissure, a deposit containing a material different from the electroconductive material, as a principal constituent by connecting the deposit to the electroconductive film, wherein the deposit is formed so that a gap narrower than the fissure is formed within the fissure.

3. A method of manufacturing an electron-emitting device, comprising a step of forming on a substrate, a pair of electroconductive films spaced apart by a first gap, and a step of forming on at least one of the electroconductive films and within the first gap, a film containing carbon as a principal constituent by connecting the film to the at least one of the electroconductive films, wherein the film containing carbon is formed so that a second gap narrower than the first gap is formed within the first gap.

4. A method of manufacturing an electron-emitting device, comprising a step of forming on a substrate, a pair of electroconductive films each comprising an electroconductive material, the electroconductive films being spaced apart by a first gap, and a step of forming on at least one of the electroconductive films and within the first gap, a film containing a material different from the electroconductive material, as a principal constituent by connecting the film to the at least one of the electroconductive films, wherein the film containing the material different from the electroconductive material is formed so that a second gap narrower than the first gap is formed within the first gap.

5. A method of manufacturing an electron-emitting device, comprising a step of forming on a substrate, a pair of electroconductive films spaced apart by a first gap, and a step of forming on the electroconductive films and within the first gap, a film containing carbon as a principal constituent by connecting the film to the electroconductive films, wherein the film containing carbon as the principal constituent is formed so that a second gap narrower than the first gap is formed within the first gap.

6. A method of manufacturing an electron-emitting device, comprising a step of forming on a substrate, a pair of electroconductive films each comprising an electroconductive material, the electroconductive films being spaced apart by a first gap, and a step of forming on the electroconductive films and within the first gap, a film containing a material different from the electroconductive material, as a principal constituent by connecting the film to the electroconductive films, wherein the film containing the material different from the electroconductive material is formed so that a second gap narrower than the first gap is formed within the first gap.

* * * * *